US011217892B2

(12) United States Patent
Lee et al.

(10) Patent No.: US 11,217,892 B2
(45) Date of Patent: Jan. 4, 2022

(54) ANTENNA STRUCTURE

(71) Applicant: Chiun Mai Communication Systems, Inc., New Taipei (TW)

(72) Inventors: Cheng-Han Lee, New Taipei (TW); Te-Chang Lin, New Taipei (TW); Huo-Ying Chang, New Taipei (TW); Min-Hui Ho, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 500 days.

(21) Appl. No.: 16/217,066

(22) Filed: Dec. 12, 2018

(65) Prior Publication Data

US 2019/0181554 A1 Jun. 13, 2019

Related U.S. Application Data

(60) Provisional application No. 62/614,364, filed on Jan. 6, 2018, provisional application No. 62/597,442, filed on Dec. 12, 2017.

(51) Int. Cl.

| | |
|---|---|
| ***H01Q 5/35*** | (2015.01) |
| ***H01Q 9/28*** | (2006.01) |
| ***H01Q 3/24*** | (2006.01) |
| ***H01Q 9/42*** | (2006.01) |
| ***H01Q 5/335*** | (2015.01) |
| ***H01Q 21/28*** | (2006.01) |
| ***H01Q 1/24*** | (2006.01) |
| ***H01Q 13/10*** | (2006.01) |
| ***H01Q 9/30*** | (2006.01) |

(52) U.S. Cl.
CPC ..... *H01Q 5/35* (2015.01); *H01Q 1/243* (2013.01); *H01Q 3/247* (2013.01); *H01Q 5/335* (2015.01); *H01Q 9/285* (2013.01); *H01Q 9/30* (2013.01); *H01Q 9/42* (2013.01); *H01Q 13/10* (2013.01); *H01Q 21/28* (2013.01)

(58) Field of Classification Search
USPC ..... 343/702
See application file for complete search history.

(56) References Cited

U.S. PATENT DOCUMENTS

2012/0009983 A1* 1/2012 Mow ..... H04B 1/40 455/575.7
2015/0372372 A1 12/2015 Lee et al.
(Continued)

FOREIGN PATENT DOCUMENTS

CN 104300215 A 1/2015
CN 105552552 A 5/2016
(Continued)

OTHER PUBLICATIONS

CN 107317095 with English translation, year 2017, 13 pgs.*

*Primary Examiner* — Trinh V Dinh
(74) *Attorney, Agent, or Firm* — ScienBiziP, P.C.

(57) ABSTRACT

An antenna structure includes a housing, a first feed source, and a second feed source. The first feed source is electrically coupled to a first radiating portion of the housing and adapted to provide an electric current to the first radiating portion. The second feed source is electrically coupled to one of a second radiating portion or a third radiating portion of the housing. The other one of the second radiating portion or the third radiating portion is electrically coupled to the first radiating portion.

20 Claims, 32 Drawing Sheets

(56) References Cited

U.S. PATENT DOCUMENTS

| | | | | |
|---|---|---|---|---|
| 2018/0026333 | A1* | 1/2018 | Lee | H01Q 13/18 343/702 |
| 2018/0026335 | A1* | 1/2018 | Lee | H01Q 13/18 343/702 |

FOREIGN PATENT DOCUMENTS

| | | | |
|---|---|---|---|
| CN | 106299685 | A | 1/2017 |
| CN | 106876897 | A | 6/2017 |
| CN | 107317095 | A | 11/2017 |

* cited by examiner

ANTENNA STRUCTURE

FIELD

The subject matter herein generally relates to antenna structures, and more particularly to an antenna structure of a wireless communication device.

BACKGROUND

As electronic devices become smaller, an antenna structure for operating in different communication bands is required to be smaller.

BRIEF DESCRIPTION OF THE DRAWINGS

Implementations of the present disclosure will now be described, by way of embodiments only, with reference to the attached figures.

DETAILED DESCRIPTION

Figure 1:
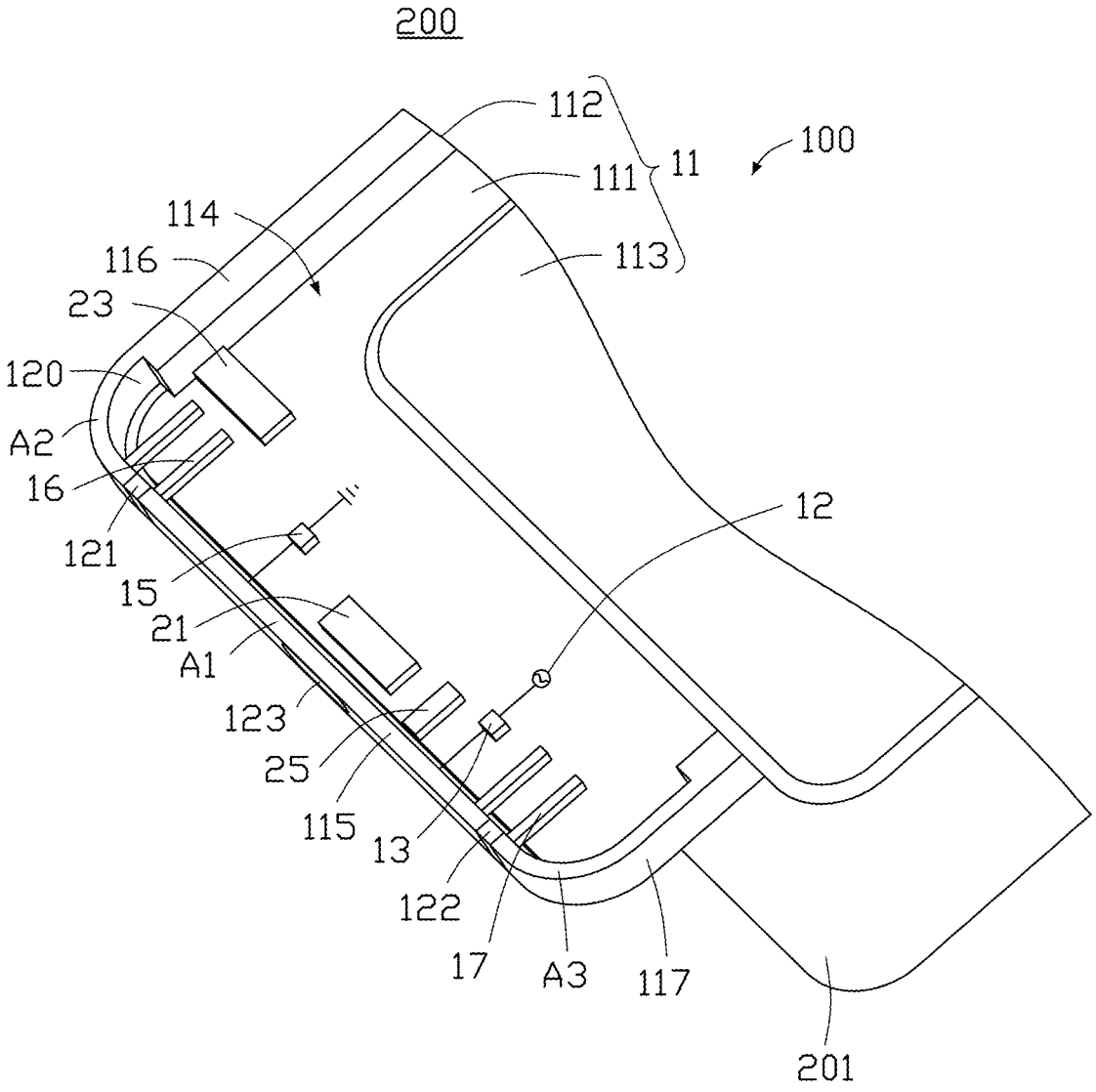
FIG. 1 is a partial isometric view of an embodiment of an antenna structure in a wireless communication device.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

Figure 2:
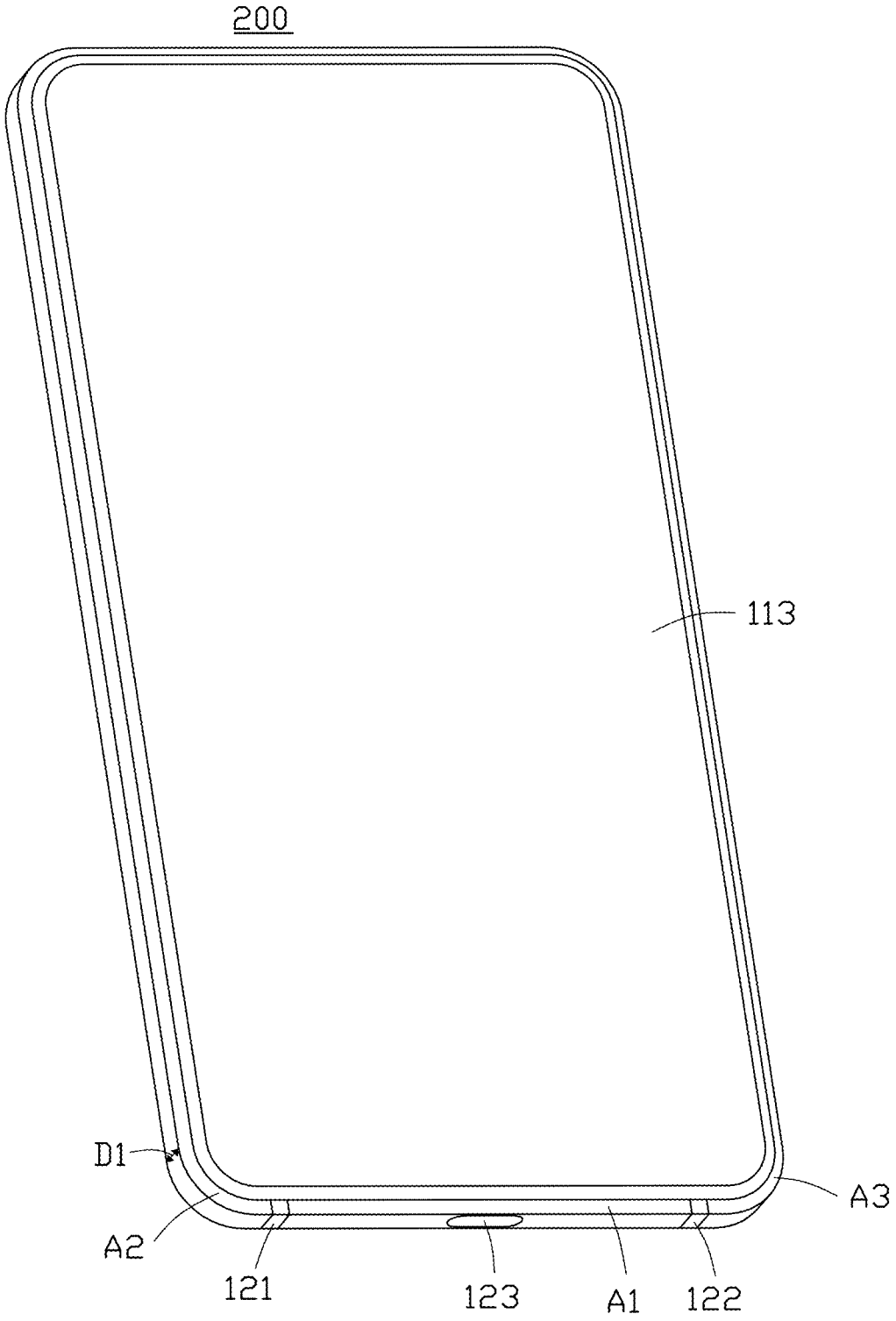
FIG. 2 is an isometric view of the communication device in FIG. 1.
Figure 3:
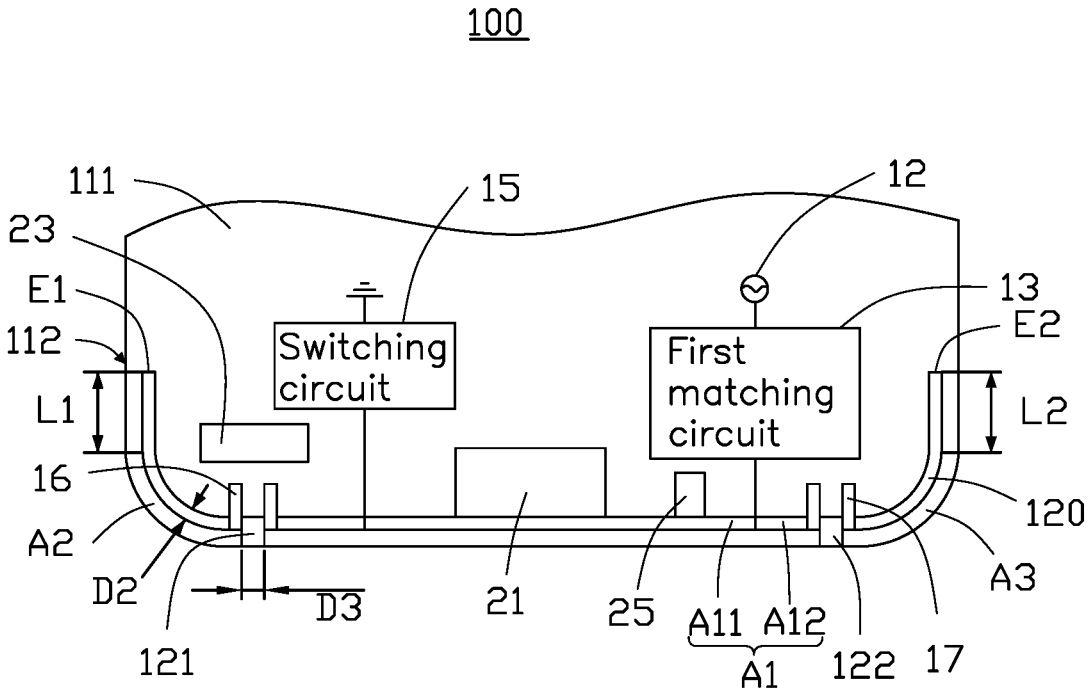
FIG. 3 is a diagram of the antenna structure in FIG. 1.

FIG. 1 and FIG. 2 show an embodiment of an antenna structure 100 applicable in a mobile phone, a personal digital assistant, or other wireless communication device 200 for sending and receiving wireless signals.

As shown in FIG. 1, the antenna structure 100 includes a housing 11, a first feed source 12, and a first matching circuit 13.

The housing 11 includes at least a middle frame 111, a border frame 112, and a backplane 113. The middle frame 111 is substantially rectangular. The middle frame 111 is made of metal. The border frame 112 is substantially hollow rectangular and is made of metal. In one embodiment, the border frame 112 is mounted around a periphery of the middle frame 111 and is integrally formed with the middle frame 111. The border frame 112 receives a display 201 mounted opposite the middle frame 111. The middle frame 111 is a metal plate mounted between the display 201 and the backplane 113. The middle frame 111 supports the display 201, provides electromagnetic shielding, and enhances durability of the wireless communication device 200.

The backplane 113 is made of insulating material, such as glass. The backplane 113 is mounted around a periphery of the border frame 112 and is substantially parallel to the display 201 and the middle frame 111. In one embodiment, the backplane 113, the border frame 112, and the middle frame 111 cooperatively define an accommodating space 114. The accommodating space 114 receives components (not shown) of the wireless communication device 200.

The border frame 112 includes at least an end portion 115, a first side portion 116, and a second side portion 117. In one embodiment, the end portion 115 is a bottom end of the wireless communication device 200. The first side portion 116 and the second side portion 117 face each other and are substantially perpendicular to the end portion 115.

In one embodiment, the border frame 112 includes an slot 120, a first gap 121, and a second gap 122. The slot 120 is substantially U-shaped and is defined in an inner side of the end portion 115. In one embodiment, the slot 120 extends along the end portion 115 and extends toward the first side portion 116 and the second side portion 117. The slot 120 insulates the end portion 115 from the middle frame 111.

In one embodiment, the first gap 121 and the second gap 122 are located on the end portion 115 and are spaced apart. The first gap 121 and the second gap 122 cut across and cut through the border frame 112. The first gap 121 and the second gap 122 are connected to the slot 120. The slot 120, the first gap 121, and the second gap 122 divide the housing 11 into a first radiating portion A1, a second radiating portion A2, and a third radiating portion A3. In one embodiment, the first radiating portion A1 is located between the first gap 121 and the second gap 122, the second radiating portion A2 is a portion of the border frame 112 located between the first gap 121 and an endpoint E1 of the first side portion 116, and the third radiating portion A3 is a portion of the border frame 112 located between the second gap 122 and an endpoint E2 of the second side portion 117. In one embodiment, the first radiating portion A1 is insulated from the middle frame 111. An end of the second radiating portion A2 adjacent the endpoint E1 and an end of the third radiating portion A3 adjacent the endpoint E2 are coupled to the middle frame 111.

In one embodiment, the border frame 112 has a thickness D1. The slot 120 has a width D2. The first gap 121 and the second gap 122 have a width D3. D1 is greater than or equal to 2*D3. D2 is less than or equal to half of D3. In one embodiment, the thickness D1 of the border frame 112 is 3-8 mm, the width D2 of the slot 120 is 0.75-2 mm. The width D3 of the first gap 121 and the second gap 122 is 1-3 mm. In one embodiment, a portion of the slot 120 from the endpoint E1 and parallel to the first side portion 116 has a length L1 of 1-10 mm. A portion of the slot 120 from the endpoint E2 and parallel to the second side portion 117 has a length L2 of 1-10 mm.

In one embodiment, the slot 120, the first gap 121, and the second gap 122 are made of insulating material, such as plastic, rubber, glass, wood, ceramic, or the like.

The wireless communication device 200 further includes at least one electronic component, such as a first electronic component 21, a second electronic component 23, and a third electronic component 25. The first electronic component 21 is a universal serial bus (USB) port located within the accommodating space 114. The first electronic component 21 is insulated from the first radiating portion A1 by the slot 120. The second electronic component 23 is a speaker and is mounted corresponding to the first gap 121 and is spaced 7-10 mm from the slot 120. The third electronic component 25 is a microphone and is mounted within the accommodating space 114. The third electronic component 25 is located between the second electronic component 23 and the slot 120 and is adjacent the second gap 122. In one embodiment, the third electronic component 25 is insulated from the first radiating portion A1 by the slot 120.

In another embodiment, the second electronic component 23 and the third electronic component 25 can be mounted in different locations according to requirements.

In one embodiment, the border frame 112 defines a port 123 in the end portion 115. The port 123 corresponds to the first electronic component 21 so that the first electronic component 21 partially protrudes through the port 123. Thus, a USB device can be inserted in the port 123 to electrically coupled to the first electronic component 21.

In one embodiment, the first feed source 12 is received within the accommodating space 114. One end of the first feed source 12 is electrically coupled to a side of the first radiating portion A1 adjacent the second gap 122 through the first matching circuit 13 for feeding a current signal to the first radiating portion A1. The first matching circuit 13 provides a matching impedance between the first feed source 12 and the first radiating portion A1.

In one embodiment, the first feed source 12 divides the first radiating portion A1 into a first radiating section A11 and a second radiating section A12. A portion of the border frame 112 between the first feed source 12 and the first gap 121 is the first radiating section A11. A portion of the border frame 112 between the first feed source 12 and the second gap 122 is the second radiating section A12. In one embodiment, the first feed source 12 is not positioned in the middle of the first radiating portion A1. Thus, a length of the first radiating section A11 is greater than a length of the second radiating section A12.

Figure 4:
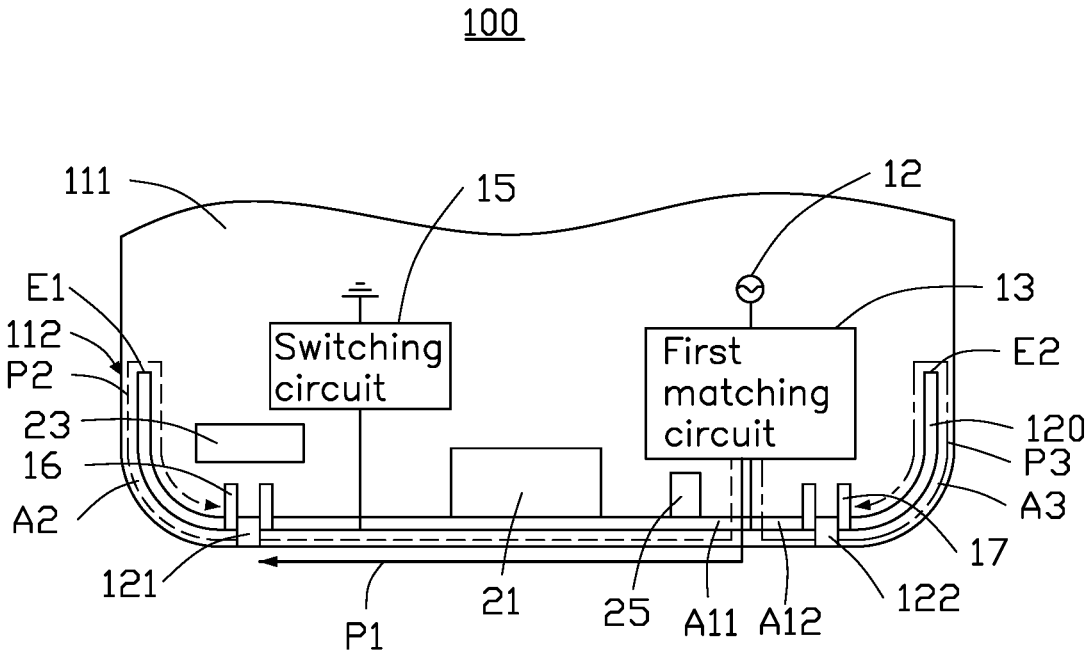
FIG. 4 is a diagram of current paths of the antenna structure in FIG. 3.

As shown in FIG. 4, when the first feed source 12 supplies an electric current, the electric current from the first feed source 12 flows through the first matching circuit 13 and the first radiating section A11 in sequence along a current path P1. Thus, the first feed source 12 and the first radiating section A11 form a monopole antenna to excite a first resonant mode and generate a radiation signal in a first frequency band.

The electric current from the first feed source 12 can also flow through the first matching circuit 13, the first radiation section A11, and then to the second radiation portion A2 through the first gap 121 along a current path P2. Thus, the first feed source 12, the first radiating section A11, and the second radiating portion A2 form a coupled feed antenna to excite a second resonant mode and generate a radiation signal in a second frequency band.

The electric current from the first feed source 12 can also flow through the first matching circuit 13 and the second radiating section A12, and then through the third radiating portion A3 through the second gap 122 along a current path P3. Thus, the first feed source 12, the second radiating section A12, and the third radiating portion A3 form a coupled feed antenna to excite a third resonant mode and generate a radiation signal in a third frequency band.

In one embodiment, the first resonant mode is a Long Term Evolution Advanced (LTE-A) low-frequency mode, the second resonant mode is an LTE-A high-frequency mode, and the third resonant mode is an LTE-A mid-frequency mode. A first frequency band of 700-960 MHz is the LTE-A low-frequency band. A second frequency band of 2300-2690 MHz is the LTE-A high-frequency band. A third frequency band of 1710-2170 MHz is the LTE-A mid-frequency band.

In one embodiment, the lengths L1 and L2 of the slot 120 adjust a frequency band of the LTE-A high-frequency and the LTE-A mid-frequency bands to adjust the frequency bands of the second radiating portion A2 and the third radiating portion A3.

Figure 5:
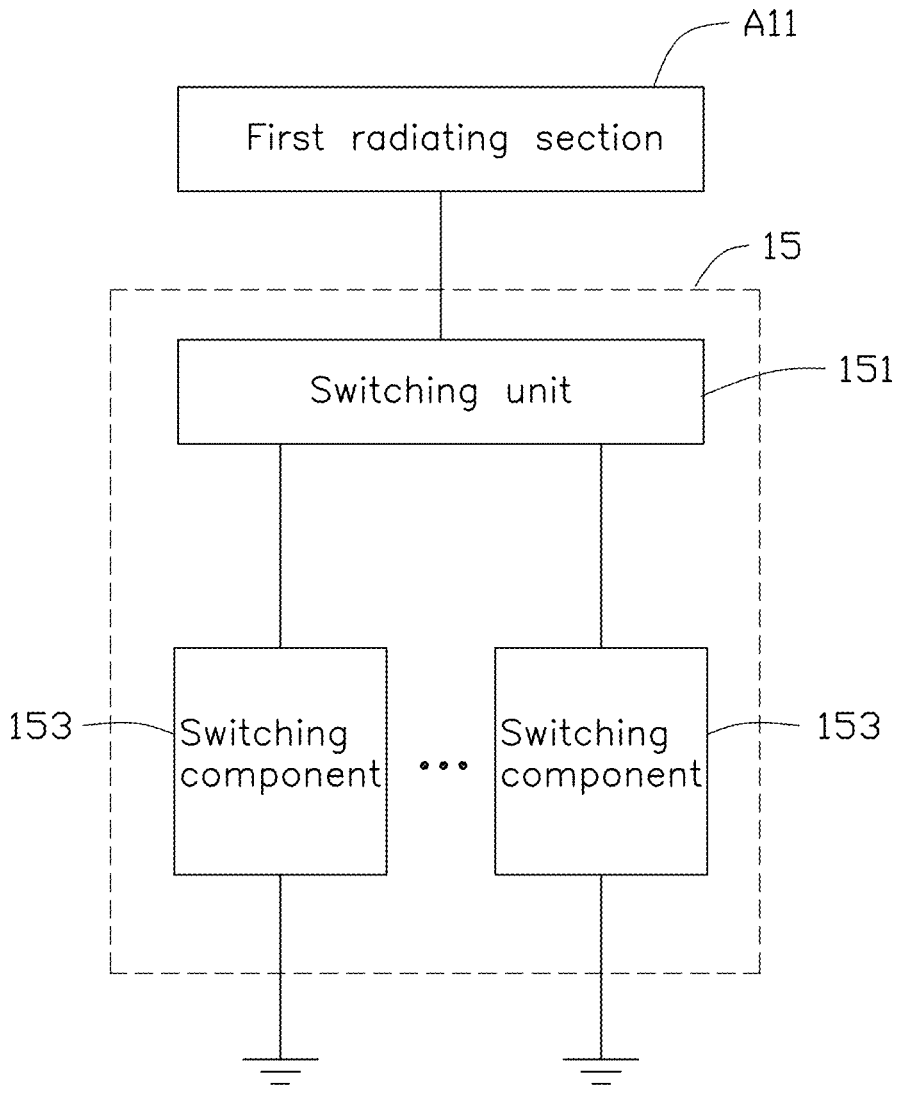
FIG. 5 is a block diagram of a switching circuit.

As shown in FIG. 5, the antenna structure 100 further includes a switching circuit 15. The switching circuit 15 is mounted within the accommodating space 114 between the first electronic component 21 and the first gap 121 adjacent to the third electronic component 23. One end of the switching circuit 15 crosses over the slot 120 and is electrically coupled to the first radiating section A11. Another end of the switching circuit 15 is grounded. The switching circuit 15 includes a switching unit 151 and at least one switching component 153. The switching unit 151 is electrically coupled to the first radiating section A11. The switching component 153 may be an inductor, a capacitor, or a combination of the two. The switching components 153 are coupled in parallel. One end of each of the switching components 153 is electrically coupled to the switching unit 151, and the other end of each of the switching components 153 is grounded.

Thus, the first radiating section A11 is switched to electrically couple to different switching components 153. Since each switching component 153 has a different impedance, the switching components 153 are switched to adjust the LTE-A low-frequency band. For example, the switching circuit 15 includes four different switching components 153. The four different switching components 153 are switched to couple to the first radiating section A11 to achieve different LTE-A low-frequency bands, such as LTE-A Band17 (704-746 MHz), LTE-A Band13 (746-787 MHz), LTE-A Band 20 (791-862 MHz), and LTE-A Band8 (880-960 MHz).

In one embodiment, the antenna structure 100 further includes a first group of extending portions 16 and a second group of extending portions 17. The first group of extending portions 16 and the second group of extending portions 17 are made of metal. The first group of extending portions 16 includes two extending portions 16. A first one of the first group of extending portions 16 is connected to an end of the first radiating section A11 adjacent to the first gap 121, and a second one of the first group of extending portions 16 is connected to an end of the second radiating portion A2 adjacent to the first gap 121. The two extending portions 16 face each other across the first gap 121. The second group of extending portions 17 includes two extending portions 17. A first one of the extending portions 17 is connected to an end the second radiating section A12 adjacent to the second gap 122, and a second one of the extending portions 17 is connected to an end of the third radiating portion A3 adjacent to the second gap 122. The two extending portions 17 face each other across the second gap 122.

A length and width of the first extending portions 16 and the second extending portions 17 can be adjusted according to requirements to adjust an impedance value of the first radiating portion A1, the second radiating portion A2, and the third radiating portion A3. The extending portions 16 and the extending portions 17 can replace a ground capacitor of the prior art.

Figure 6:
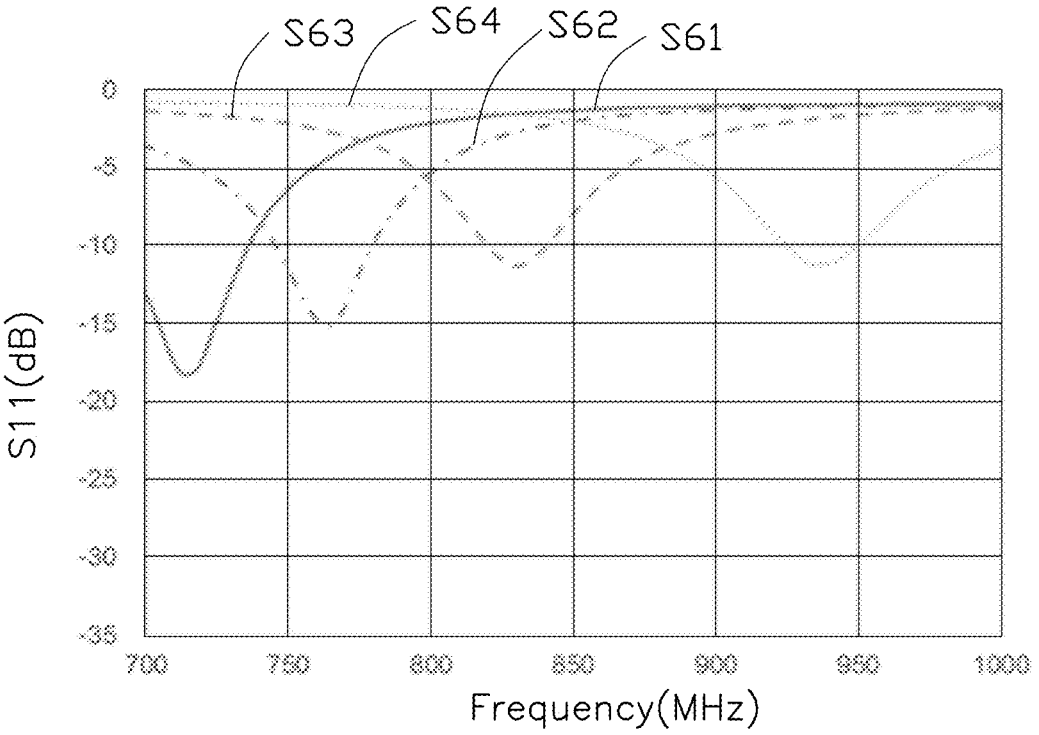
FIG. 6 is a graph of S11 values of an LTE-A low-frequency mode.

FIG. 6 shows a graph of scattering values (S11 values) of the LTE-A low-frequency mode. A plotline S61 represents S11 values of LTE-A Band17 (704-746 MHz). A plotline S62 represents S11 values of LTE-A Band13 (746-787 MHz). A plotline S63 represents S11 values of LTE-A Band20 (791-862 MHz). A plotline S64 represents S11 values of LTE-A Band8 (880-960 MHz).

Figure 7:
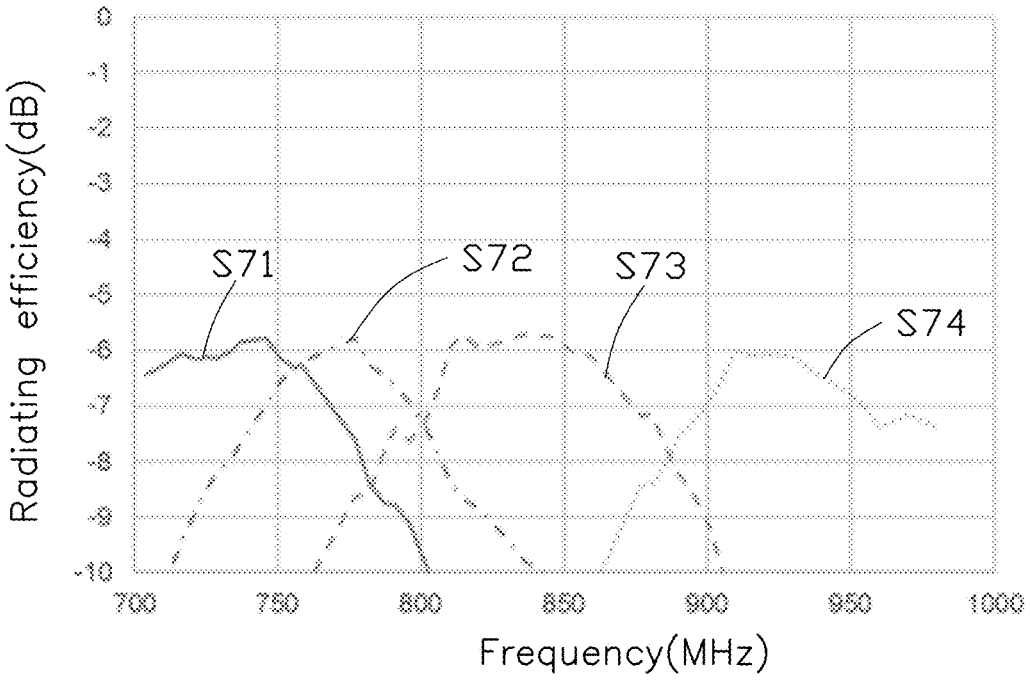
FIG. 7 is a graph of total radiation efficiency of the LTE-A low-frequency mode.

FIG. 7 shows a graph of total radiation efficiency of the LTE-A low-frequency mode. A plotline S71 represents LTE-A Band17 (704-746 MHz). A plotline S72 represents LTE-A Band13 (746-787 MHz). A plotline S73 represents LTE-A Band20 (791-862 MHz). A plotline S74 represents LTE-A Band8 (880-960 MHz).

Figure 8:
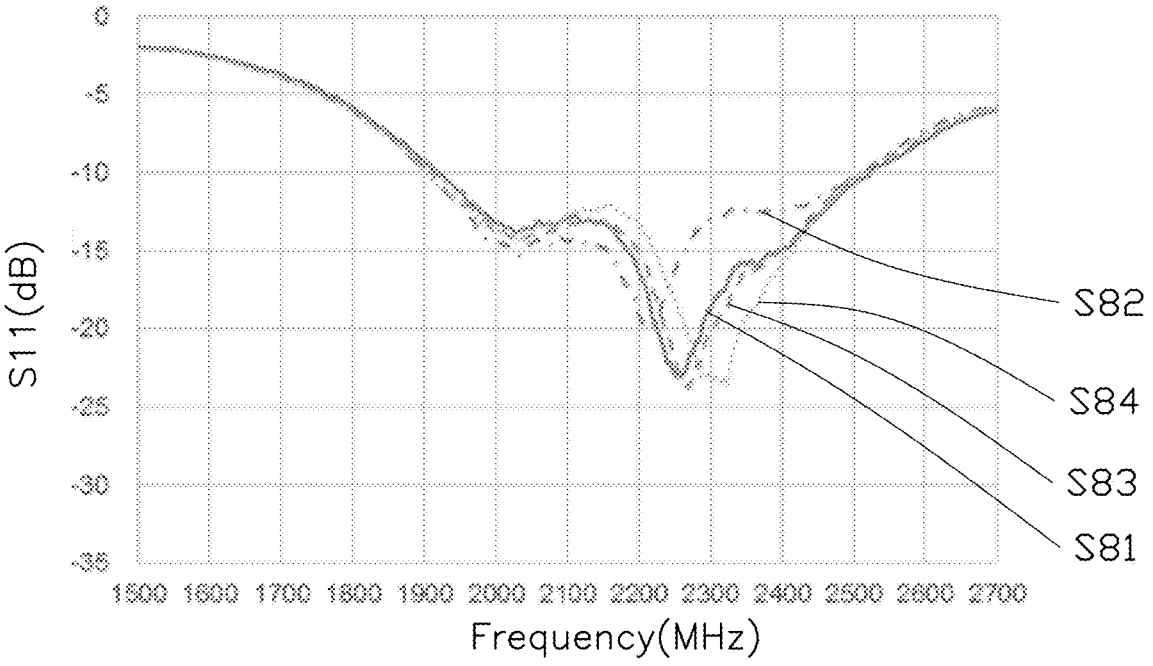
FIG. 8 is a graph of S11 values of the LTE-A mid-high-frequency modes.

FIG. 8 shows a graph of S11 values of the LTE-A mid-high-frequency modes. A plotline S81 represents S11 values of LTE-A Band17 (704-746 MHz) when the antenna structure 100 operates in the LTE-A mid-high-frequency modes. A plotline S82 represents S11 values of LTE-A Band13 (746-787 MHz) when the antenna structure 100 operates in the LTE-A mid-high-frequency modes. A plotline S83 represents S11 values of LTE-A Band20 (791-862 MHz) when the antenna structure 100 operates in the LTE-A mid-high-frequency modes. A plotline S84 represents S11 values of LTE-A Band8 (880-960 MHz) when the antenna structure 100 operates in the LTE-A mid-high-frequency modes.

Figure 9:
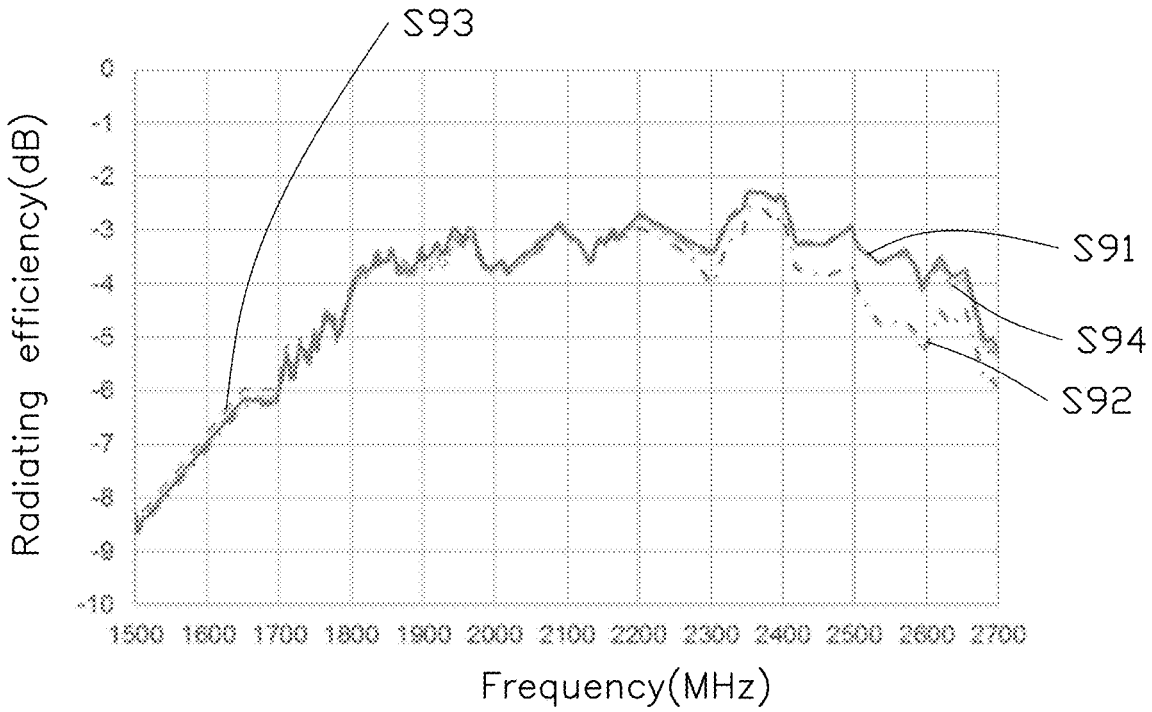
FIG. 9 is a graph of total radiation efficiency of the LTE-A mid-high-frequency modes.

FIG. 9 shows a graph of total radiation efficiency of the LTE-A mid-high-frequency modes. A plotline S91 represents LTE-A Band17 (704-746 MHz) when the antenna structure 100 operates in the LTE-A mid-high-frequency modes. A plotline S92 represents LTE-A Band13 (746-787 MHz) when the antenna structure 100 operates in the LTE-A mid-high-frequency modes. A plotline S93 represents LTE-A Band20 (791-862 MHz) when the antenna structure 100 operates in the LTE-A mid-high-frequency modes. A plotline S94 represents LTE-A Band8 (880-960 MHz) when the antenna structure 100 operates in the LTE-A mid-high-frequency modes.

As shown in FIGS. 8 and 9, when the antenna structure 100 operates in the LTE-A Band17 (704-746 MHz), LTE-A Band13 (746-787 MHz), LTE-A Band20 (791-862 MHz), and the LTE-A Band8 (880-960 MHz), the LTE-A mid and high-frequency band range is from 1710-2690 MHz. The switching circuit 15 adjusts the low-frequency band and does not affect the mid and high-frequency bands.

Figure 10:
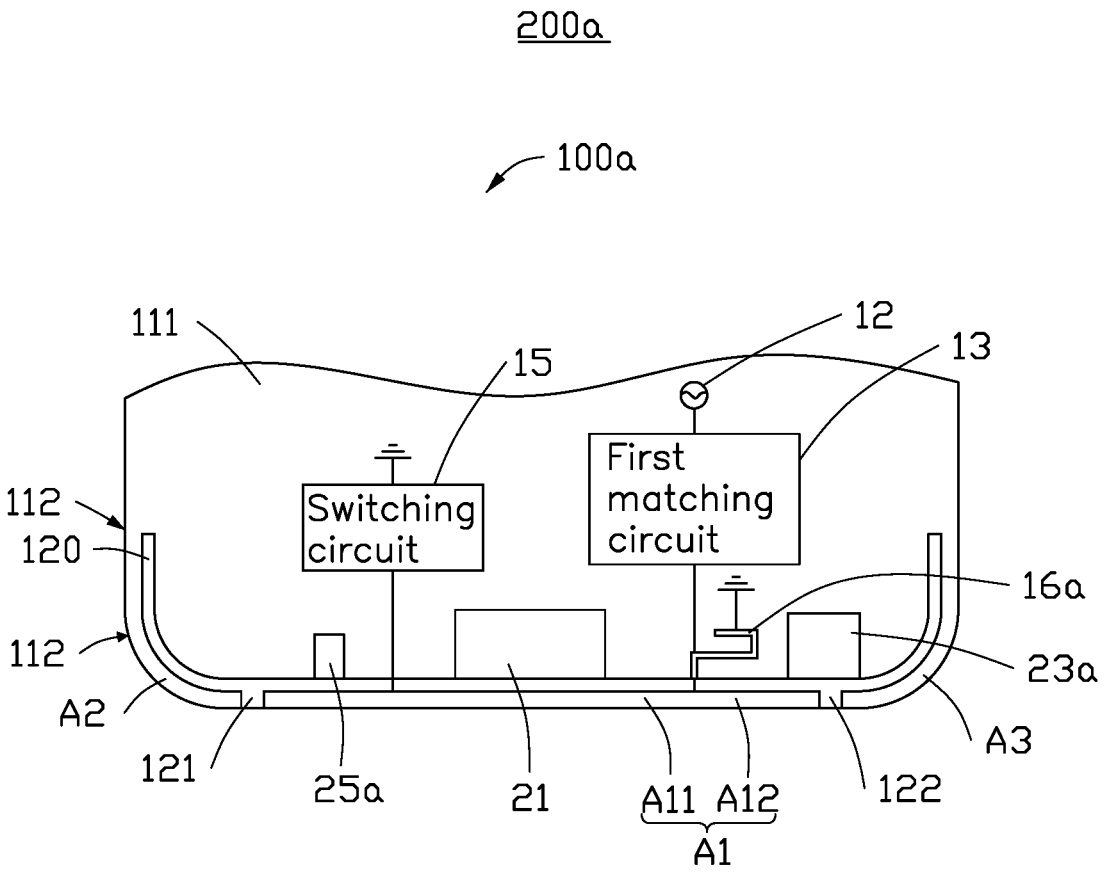
FIG. 10 is a diagram of a second embodiment of an antenna structure.

FIG. 10 shows a second embodiment of an antenna structure 100*a* in a wireless communication device 200*a*.

The antenna structure 100*a* includes a middle frame 111, a border frame 112, a first feed source 12, a first matching circuit 13, and a switching circuit 15. The wireless communication device 200*a* includes a first electronic component 21, a second electronic component 23*a*, and a third electronic component 25*a*.

The border frame 112 includes an slot 120, a first gap 121, and a second gap 122. The first gap 121 and the second gap 122 cut across and cut through the border frame 112. The slot 120, the first gap 121, and the second gap 122 separate the housing 11 into a first radiating portion A1, a second radiating portion A2, and a third radiating portion A3. The first feed source 12 is electrically coupled to the first radiating portion A1 through the first matching circuit 13 to divide the first radiation portion A1 into a first radiating section A11 and a second radiating section A12. One end of the switching circuit 15 is electrically coupled to the first radiating section A11, and a second end of the switching circuit 15 is grounded.

One difference between the antenna structure 100*a* and the antenna structure 100 is that in the antenna structure 100*a*, a location of the second electronic component 23*a* and the third electronic component 25*a* is different. Specifically, the second electronic component 23*a* is mounted corresponding to the second gap 122 and is insulated from the slot 120. The third electronic component 25*a* is located between the switching circuit 15 and the first gap 121 adjacent to the switching circuit 15.

Another difference between the antenna structure 100*a* and the antenna structure 100 is that in the antenna structure 100*a*, the first extending portions 16 and the second extending portions 17 are omitted.

Figure 11:
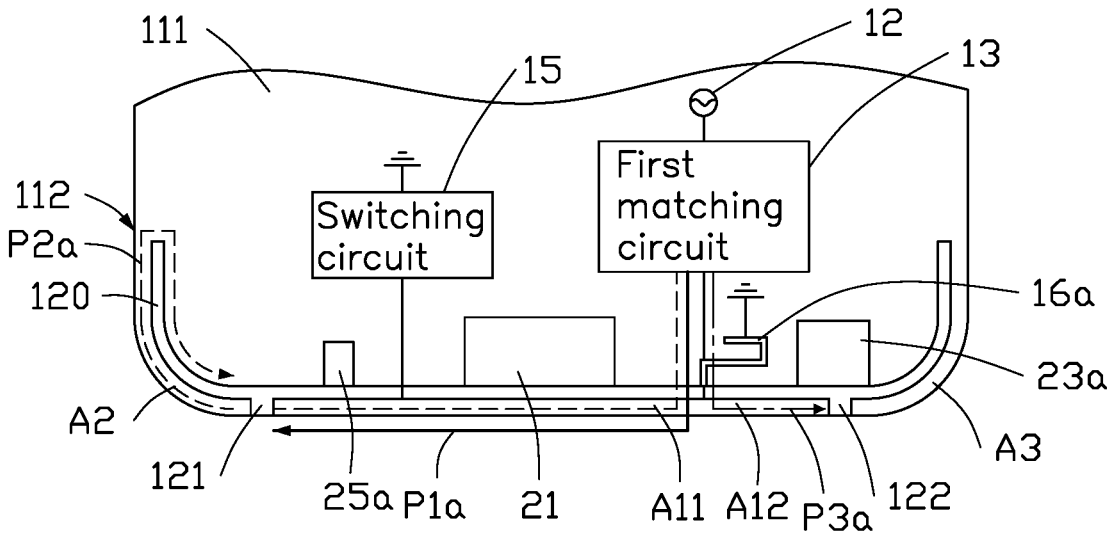
FIG. 11 is a diagram of current paths of the antenna structure in FIG. 12.

Another difference between the antenna structure 100*a* and the antenna structure 100 is that in the antenna structure 100*a*, circuit paths are different. Specifically, as shown in FIG. 11, when the first feed source 12 supplies an electric current, the electric current from the first feed source 12 flows through the first matching circuit 13 and the first radiating section A11 along a circuit path P1*a*. Thus, the first feed source 12 and the first radiating section A11 form a monopole antenna to excite a first resonant mode and generate a radiation signal in a first frequency band.

Electric current from the first feed source 12 can also flow along a current path P2*a* through the first matching circuit 13 and the first radiating section A11, and then to the second radiating portion A2 through the first gap 121. Thus, the first feed source 12, the first radiating section A11, and the second radiating portion A2 form a coupled feed antenna to excite a second resonant mode and generate a radiation signal in a second frequency band.

Electric current from the first feed source 12 can also flow through the first matching circuit 13 and the second radiating section A12 along a current path P3*a*. Thus, the first feed source 12 and the second radiating section A12 form a monopole antenna to excite a third resonant mode and generate a radiation signal in a third frequency band.

In one embodiment, the first resonant mode is a Long Term Evolution Advanced (LTE-A) low-frequency mode, the second resonant mode is an LTE-A mid-high-frequency mode, and the third resonant mode is an LTE-A mid-high-frequency mode. The first frequency band is 700-960 MHz. The second frequency band is 2000-2690 MHz. The third frequency band is 1710-2300 MHz.

Another difference between the antenna structure 100*a* and the antenna structure 100 is that the antenna structure 100*a* further includes a ground portion 16*a*. The ground portion 16*a* is made of metal and is curved. A first end of the ground portion 16*a* is electrically coupled between the first matching circuit 13 and the first radiating portion A1. A second end of the ground portion 16*a* is grounded. Thus, the first feed source 12 and the first radiating section A11 form a shorting monopole antenna. In one embodiment, the ground portion 16*a* enhances a radiation efficiency and bandwidth of the low-frequency band and reduces an impedance loss.

Figure 12:
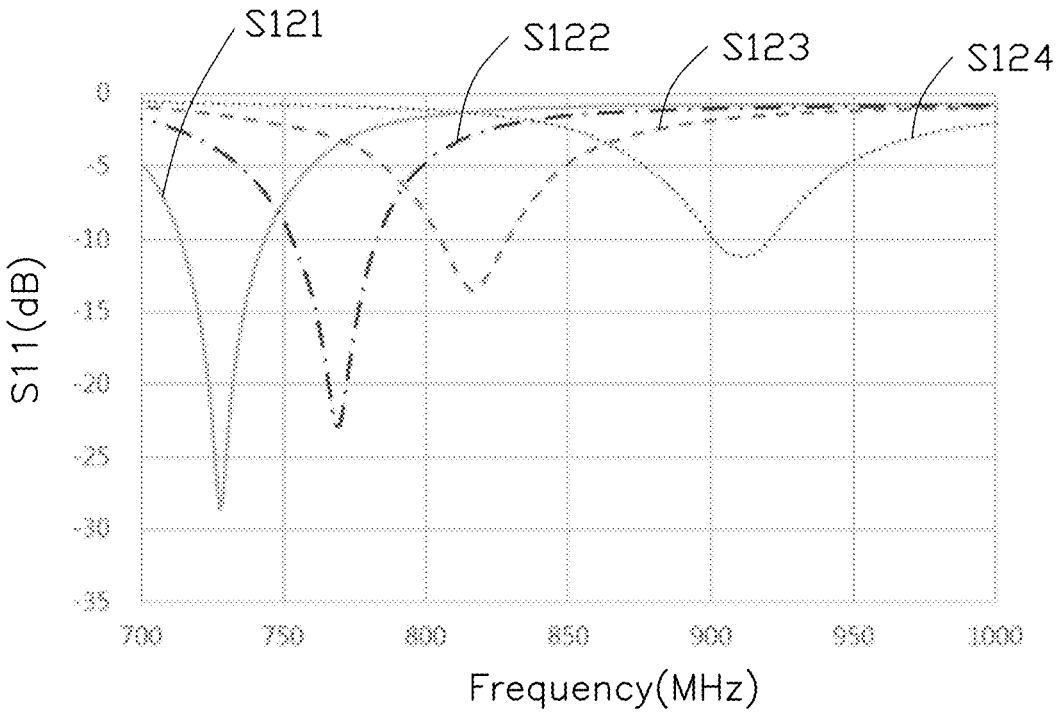
FIG. 12 is a graph of S11 values of the LTE-A low-frequency mode of the second embodiment of the antenna structure.

FIG. 12 shows a graph of scattering values (S11 values) of the LTE-A low-frequency mode. A plotline S121 represents S11 values of LTE-A Band17 (704-746 MHz). A plotline S122 represents S11 values of LTE-A Band13 (746-787 MHz). A plotline S123 represents S11 values of LTE-A Band20 (791-862 MHz). A plotline S124 represents S11 values of LTE-A Band8 (880-960 MHz).

Figure 13:
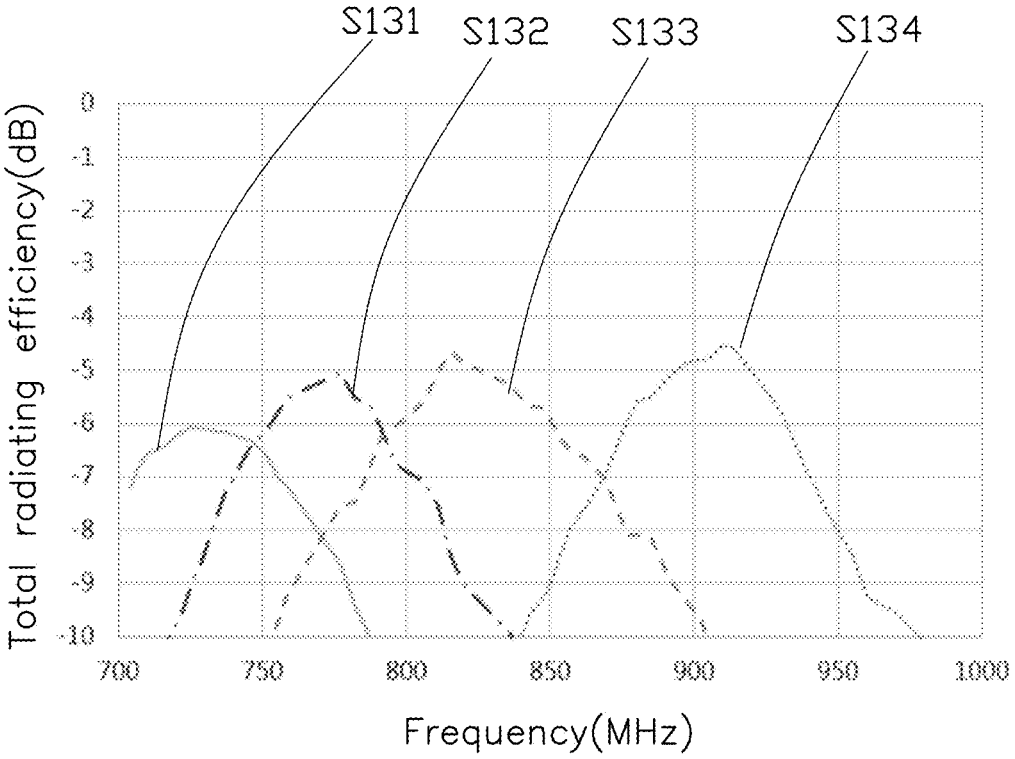
FIG. 13 is a graph of total radiation efficiency of the LTE-A low-frequency mode.

FIG. 13 shows a graph of total radiation efficiency of the LTE-A low-frequency mode. A plotline S131 represents LTE-A Band17 (704-746 MHz). A plotline S132 represents LTE-A Band13 (746-787 MHz). A plotline S133 represents LTE-A Band20 (791-862 MHz). A plotline S134 represents LTE-A Band8 (880-960 MHz).

Figure 14:
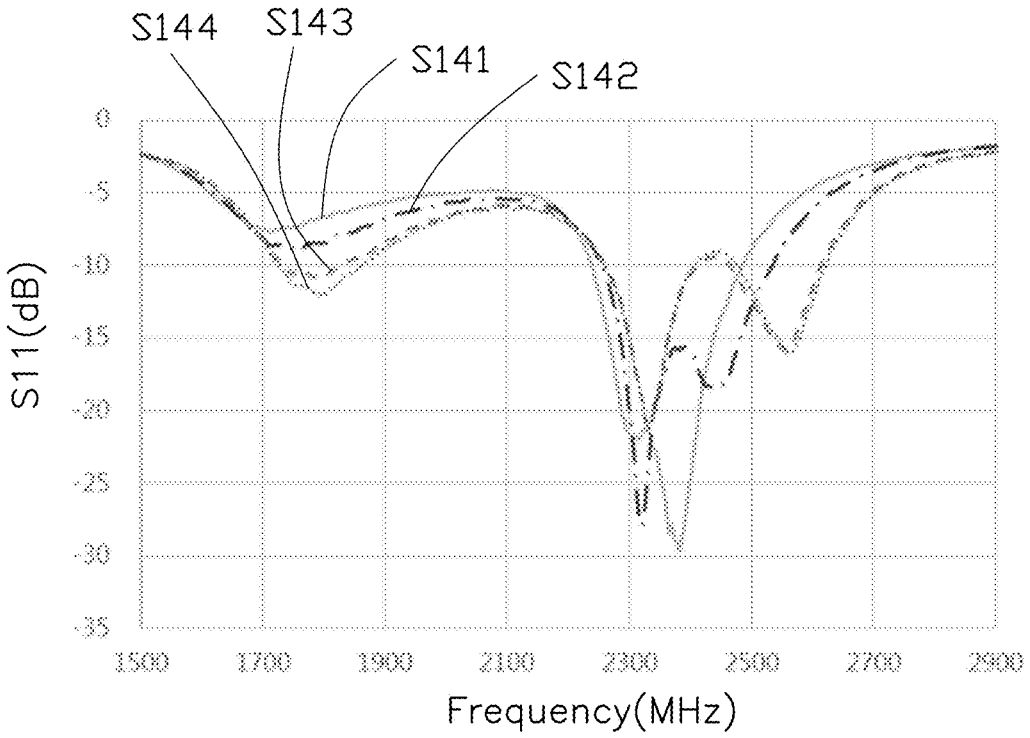
FIG. 14 is a graph of S11 values of the LTE-A mid-high-frequency mode.

FIG. 14 shows a graph of scattering values (S11 values) of the LTE-A mid-high-frequency mode. A plotline S141 represents S11 values of LTE-A Band17 (704-746 MHz) when the antenna structure 100*a* operates in the LTE-A mid-high-frequency mode. A plotline S142 represents S11 values of LTE-A Band13 (746-787 MHz) when the antenna structure 100*a* operates in the LTE-A mid-high-frequency mode. A plotline S143 represents S11 values of LTE-A Band20 (791-862 MHz) when the antenna structure 100*a* operates in the LTE-A mid-high-frequency mode. A plotline S144 represents S11 values of LTE-A Band8 (880-960 MHz) when the antenna structure 100*a* operates in the LTE-A mid-high-frequency mode.

Figure 15:
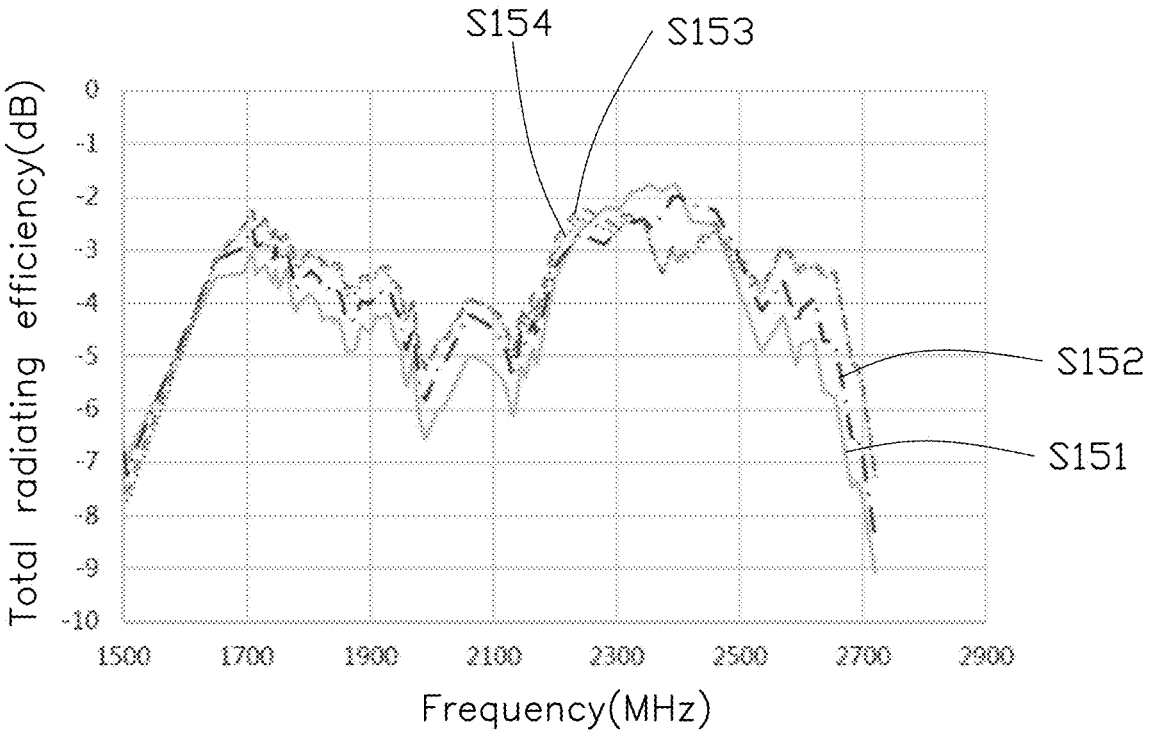
FIG. 15 is a graph of total radiation efficiency of the LTE-A mid-high-frequency mode.

FIG. 15 shows a graph of total radiation efficiency of the LTE-A mid-high-frequency mode. A plotline S151 represents LTE-A Band17 (704-746 MHz) when the antenna structure 100*a* operates in the LTE-A mid-high-frequency mode. A plotline S152 represents LTE-A Band13 (746-787 MHz) when the antenna structure 100*a* operates in the LTE-A mid-high-frequency mode. A plotline S153 represents LTE-A Band20 (791-862 MHz) when the antenna structure 100*a* operates in the LTE-A mid-high-frequency mode. A plotline S154 represents LTE-A Band8 (880-960 MHz) when the antenna structure 100*a* operates in the LTE-A mid-high-frequency mode.

As shown in FIGS. 12 and 13, the low-frequency mode is excited by the first radiating section A11, and the switching circuit 15 adjusts the low-frequency band to include the LTE-A Band17, the LTE-A Band13, the LTE-A Band20, and the LTE-A Band8. As shown in FIGS. 14 and 15, the second radiating section A12 excites a portion of the low-high-frequency band and includes LTE-A 1710-2300 MHz. The second radiating portion A2 coupled with the first radiating section A11 excites a second portion of the low-high-frequency band and includes LTE-A 2000-2690 MHz.

The switching circuit 15 adjusts the low-frequency band to operate within LTE-A Band17, LTE-A Band13, LTE-A Band20, or LTE-A Band8. Thus, the switching circuit 15 does not affect operation of the mid-high-frequency band LTE-A 1710-2690 MHz.

Figure 16:
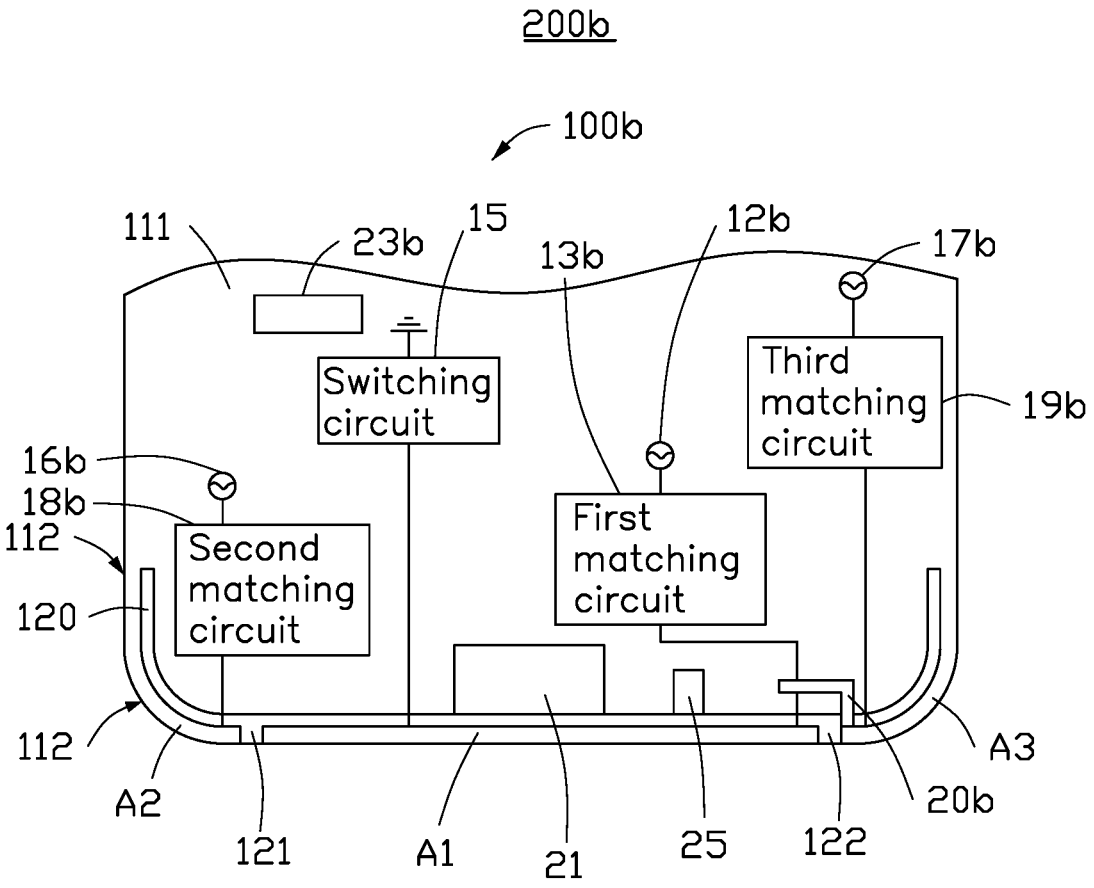
FIG. 16 is a diagram of a third embodiment of an antenna structure.

FIG. 16 shows a third embodiment of an antenna structure 100*b*.

The antenna structure 100*b* includes a middle frame 111, a border frame 112, a first feed source 12*b*, a first matching circuit 13*b*, and a switching circuit 15. The wireless communication device 200*b* includes a first electronic component 21, a second electronic component 23*b*, and a third electronic component 25.

The border frame 112 includes an slot 120, a first gap 121, and a second gap 122. The slot 120, the first gap 121, and the second gap 122 divide the housing 11 into a first radiating portion A1, a second radiating portion A2, and a third radiating portion A3.

One difference between the antenna structure 100*b* and the antenna structure 100 is that in the antenna structure 100*b*, a location of the second electronic component 23*b* is different. Specifically, the second electronic component 23*b* is mounted between the switching circuit 15 and the first gap 121. The second electronic component 23*b* is insulated from the slot 120 and is spaced 4-10 mm from the slot 120.

Another difference between the antenna structure 100*b* and the antenna structure 100 is that in the antenna structure 100*b*, the first feed source 12*b* and the first matching circuit 13*b* are coupled to the first radiating portion A1 at a different location. Specifically, one end of the first feed source 12*b* is electrically coupled to an end of the first radiating portion A1 through the first matching circuit 13*b* adjacent to the second gap 122. Thus, the first feed source 12*b* does not divide the first radiating portion A1 into two sections, and electric current from the first feed source 12*b* flows directly through the first radiating portion A1.

Another difference between the antenna structure 100*b* and the antenna structure 100 is that the antenna structure 100*b* further includes a second feed source 16*b*, a third feed source 17*b*, a second matching circuit 18*b*, and a third matching circuit 19*b*. The second feed source 16*b* is mounted within the accommodating space 114. One end of the second feed source 16*b* is electrically coupled to an end of the second radiating portion A2 through the second matching circuit 18*b* adjacent to the first gap 121 for providing electric current to the second radiating portion A2. The third feed source 17*b* is mounted within the accommodating space 114. One end of the third feed source 17*b* is electrically coupled to an end of the third radiating portion A3 through the third matching circuit 19*b* adjacent to the second gap 122 for providing electric current to the third radiating portion A3.

Another difference between the antenna structure 100*b* and the antenna structure 100 is that in the antenna structure 100*b*, the first extending portions 16 and the second extending portions 17 are omitted. The antenna structure 100*b* includes a coupling portion 20*b*. The coupling portion 20*b* is made of metal and is received within the accommodating space 114. The coupling portion 20*b* is substantially L-shaped. The coupling portion 20*b* is connected and electrically coupled to an end of the third radiating portion A3 adjacent to the second gap 122 and extends along a direction away from the end portion 115 and parallel to the first side portion 116, and then bends perpendicularly, and then extends along a direction parallel to the end portion 115 and toward the first side portion until beyond the second gap 122.

Figure 17:
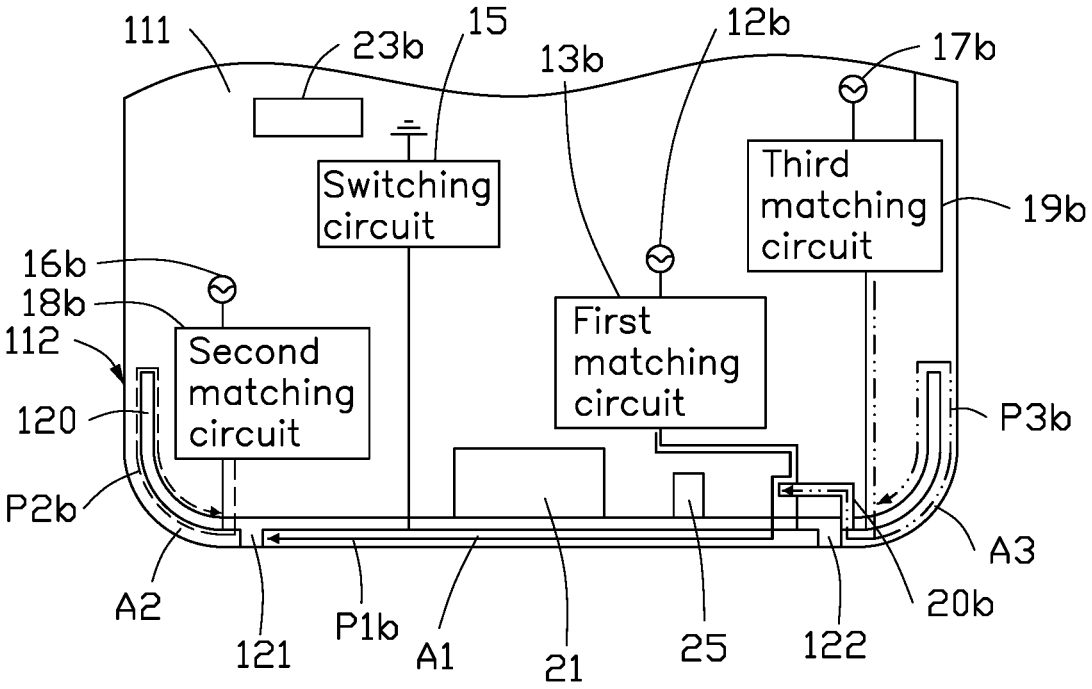
FIG. 17 is a diagram of current paths of the antenna structure in FIG. 20.

Another difference between the antenna structure 100*b* and the antenna structure 100 is that in the antenna structure 100*b*, circuit paths are different. Specifically, as shown in FIG. 17, when the first feed source 12*b* supplies electric current, electric current from the first feed source 12*b* flows through the first matching circuit 13*b* and the first radiating portion A1 toward the first gap 121 along a circuit path P1*b*. Thus, the first feed source 12*b* and the first radiating portion A1 form a monopole antenna to excite a first resonant mode and generate a radiation signal in a first frequency band.

When the second feed source 16*b* supplies electric current, the electric current from the second feed source 16*b* flows along a current path P2*b* through the second matching circuit 18*b* and the second radiating portion A2. Thus, the second feed source 16*b* and the second radiating portion A2 form a loop antenna to excite a second resonant mode and generate a radiation signal in a second frequency band.

When the third feed source 17*b* supplies electric current, the electric current from the third feed source 17*b* is split into two currents. A first current flows through the third matching circuit 19*b* and the third radiating portion A3. A second current flows through the third matching circuit 19*b* and a portion of the third radiating portion A3 adjacent to the second gap 122 and through the coupling portion 20*b*. The first current and the second current form a current path P3*b*. Thus, the third feed source 17*b*, the third radiating portion A3, and the coupling portion 20*b* excite a third resonant mode and generate a radiation signal in a third frequency band.

In one embodiment, the first resonant mode is a Long Term Evolution Advanced (LTE-A) low-frequency mode, the second resonant mode is an LTE-A high-frequency mode, and the third resonant mode is an LTE-A mid-frequency mode. The first frequency band is 700-960 MHz. The second frequency band is 2300-2690 MHz. The third frequency band is 1710-2170 MHz.

Figure 18:
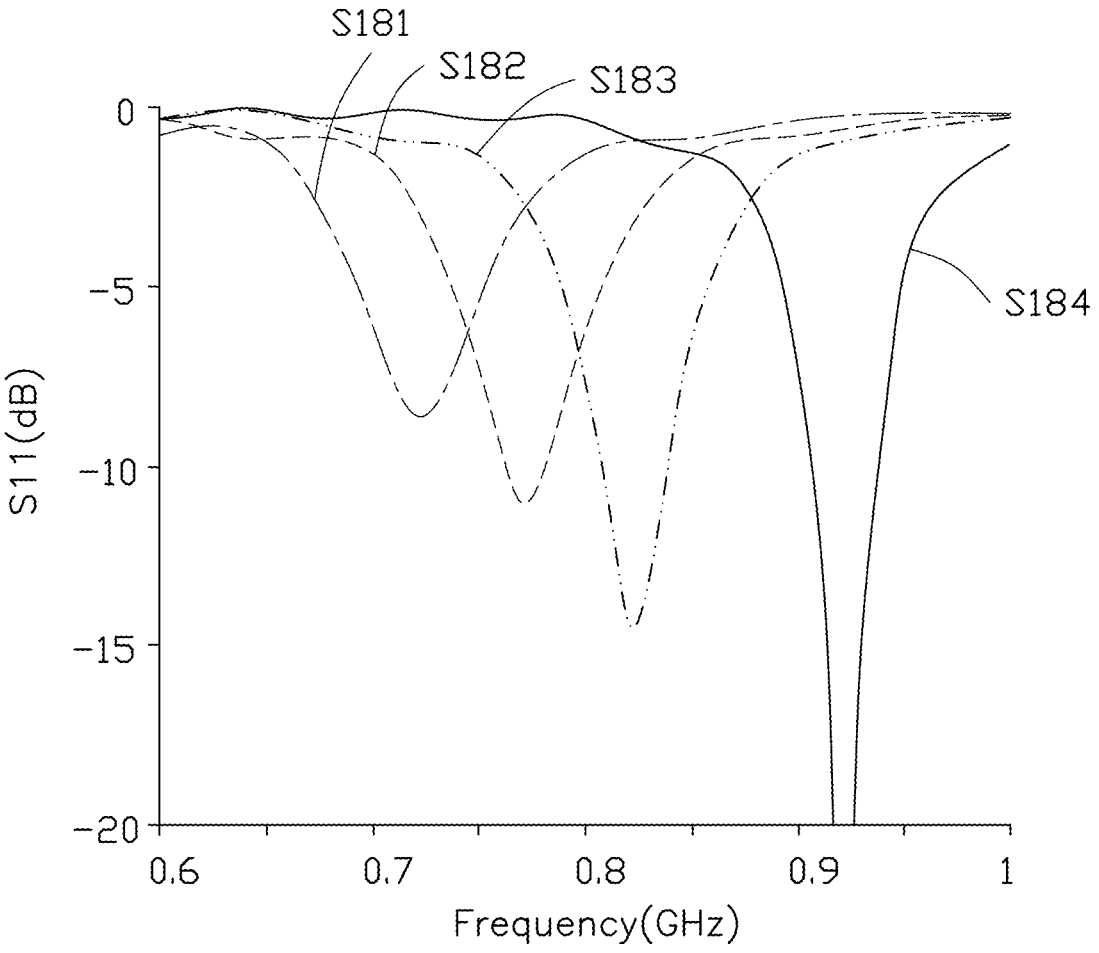
FIG. 18 is a graph of scattering values (S11 values) of the LTE-A low-frequency mode.

FIG. 18 shows a graph of scattering values (S11 values) of the LTE-A low-frequency mode. A plotline S181 represents S11 values of LTE-A Band17 (704-746 MHz). A plotline S182 represents S11 values of LTE-A Band13 (746-787 MHz). A plotline S183 represents S11 values of LTE-A Band20 (791-862 MHz). A plotline S184 represents S11 values of LTE-A Band8 (880-960 MHz).

Figure 19:
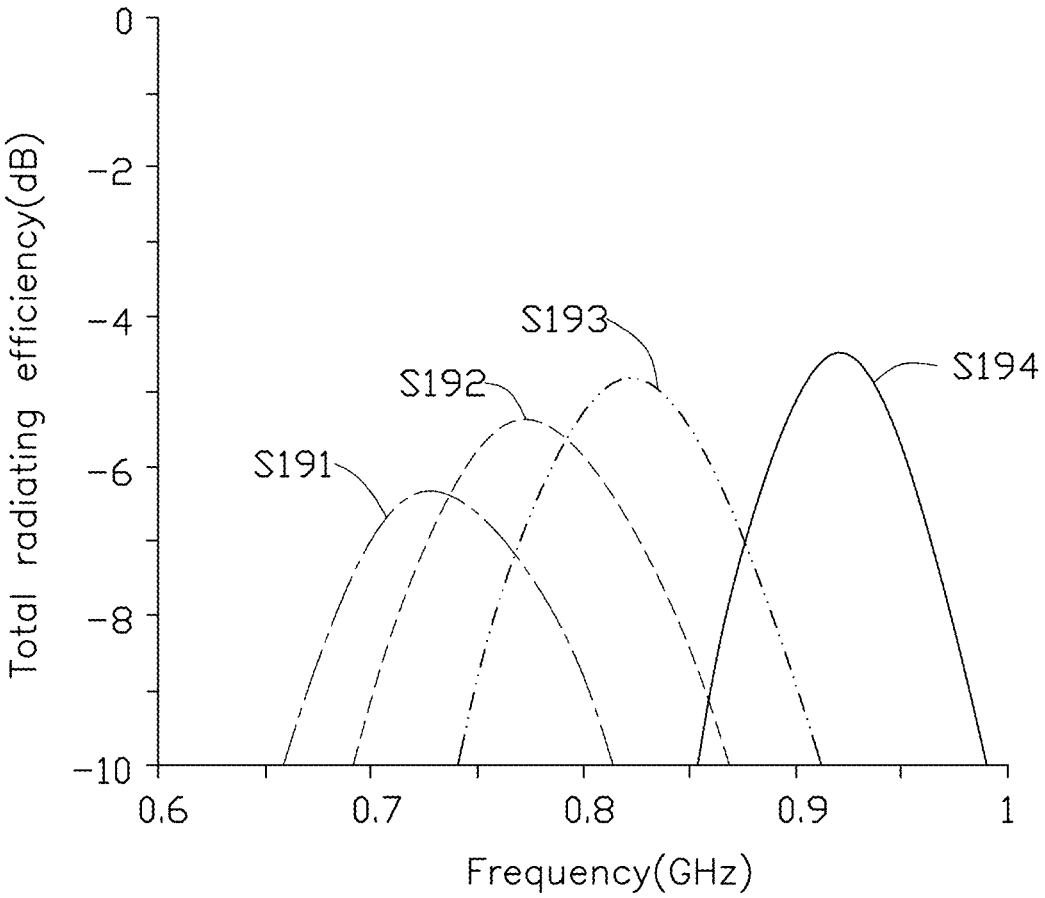
FIG. 19 is a graph of total radiation efficiency of the LTE-A low-frequency mode.

FIG. 19 shows a graph of total radiation efficiency of the LTE-A low-frequency mode. A plotline S191 represents LTE-A Band17 (704-746 MHz). A plotline S192 represents LTE-A Band13 (746-787 MHz). A plotline S193 represents LTE-A Band20 (791-862 MHz). A plotline S194 represents LTE-A Band8 (880-960 MHz).

Figure 20:
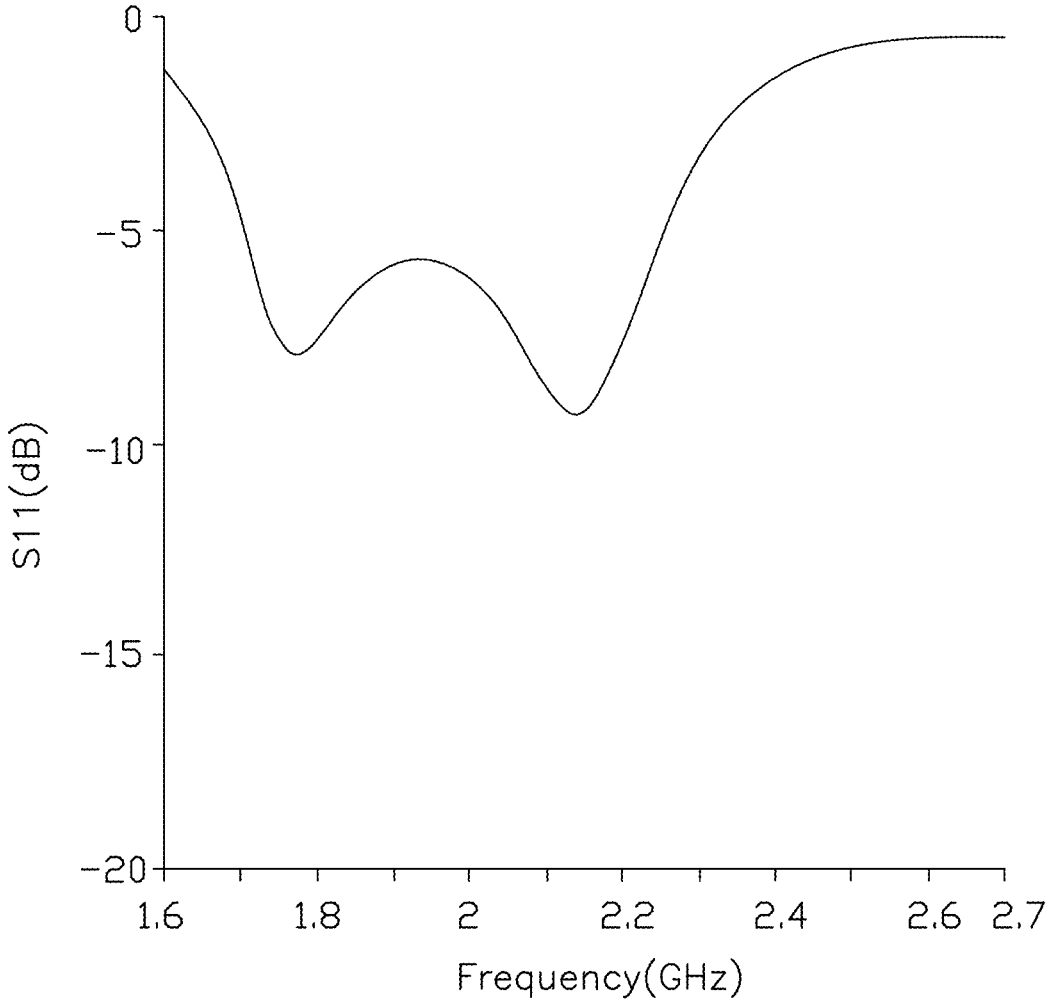
FIG. 20 is a graph of S11 values of the LTE-A mid-frequency mode of the third embodiment of the antenna structure.

FIG. 20 shows a graph of scattering values (S11 values) of the LTE-A mid-frequency mode.

Figure 21:
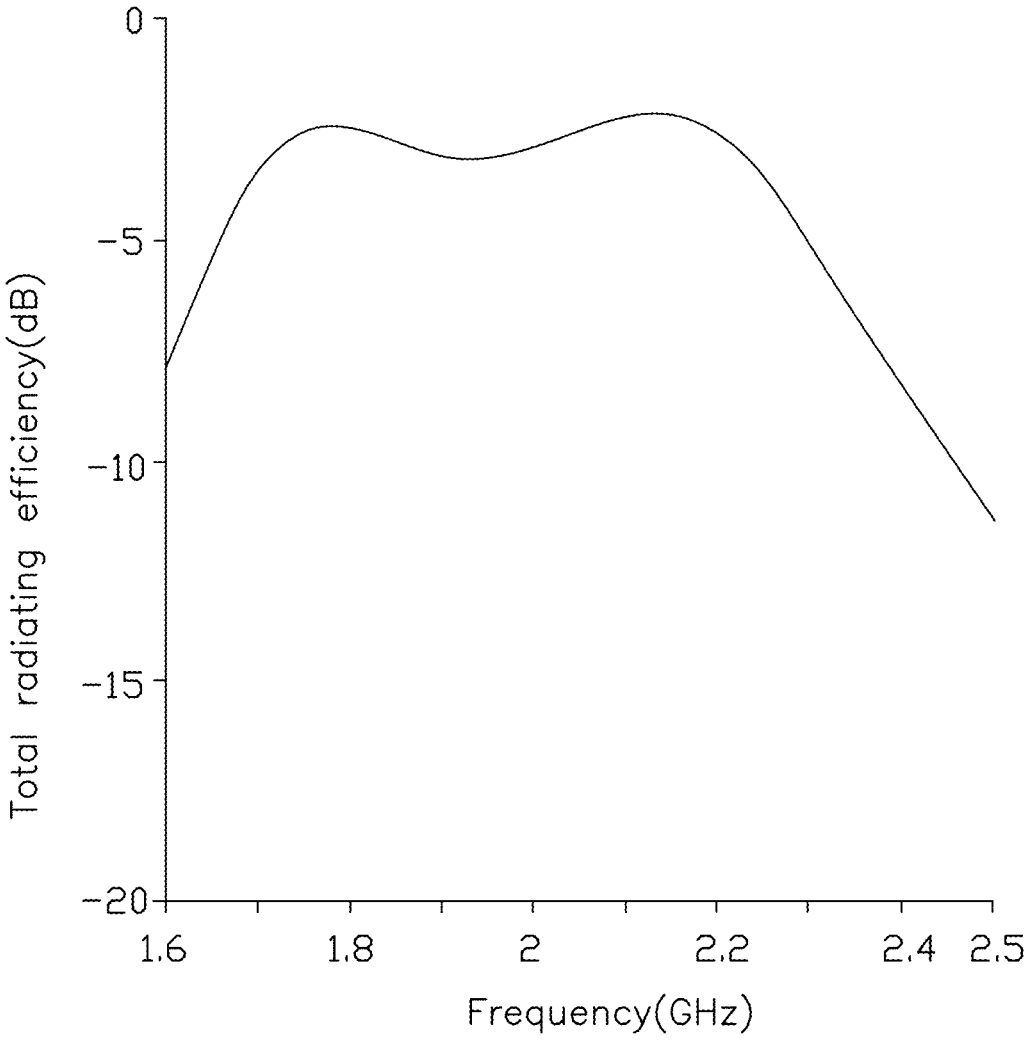
FIG. 21 is a graph of total radiation efficiency of the LTE-A mid-frequency mode.

FIG. 21 shows a graph of total radiation efficiency of the LTE-A mid-frequency mode.

Figure 22:
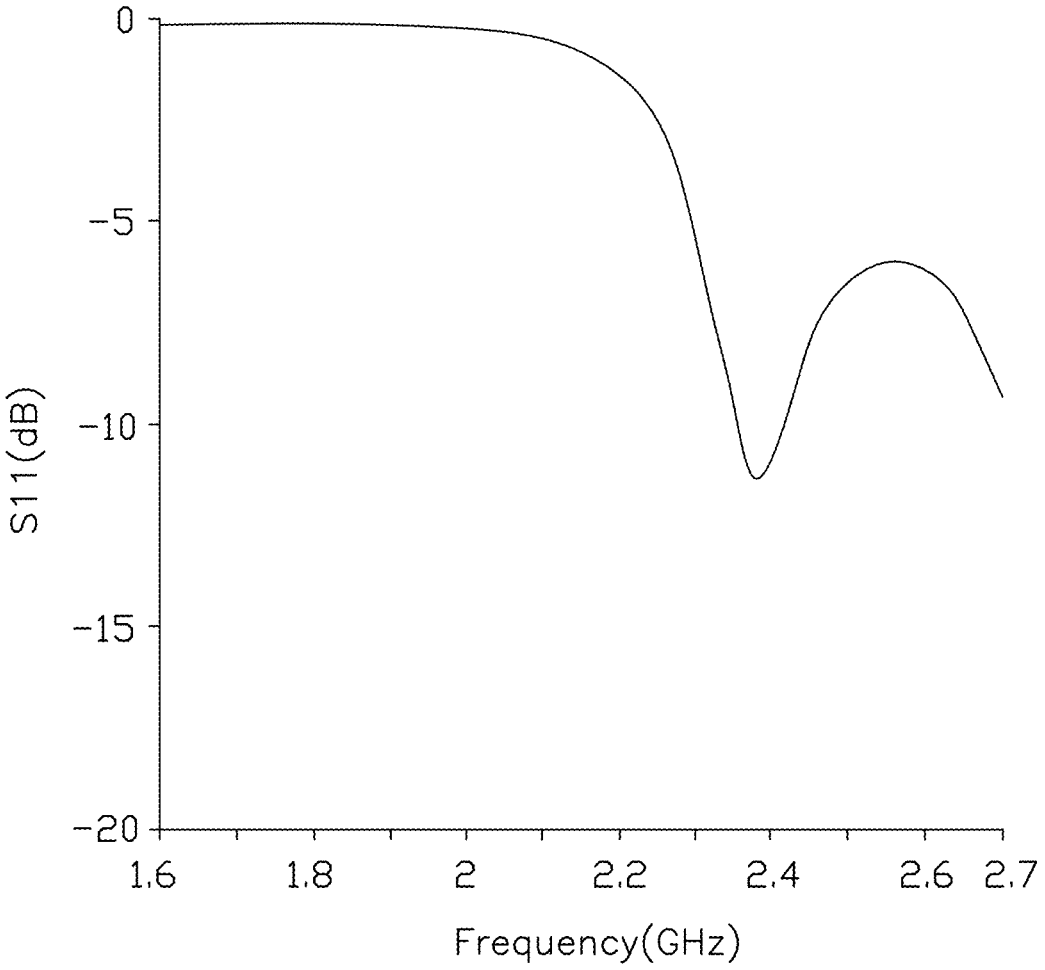
FIG. 22 is a graph of S11 values of the LTE-A high-frequency mode.

FIG. 22 shows a graph of S11 values of the LTE-A high-frequency mode.

Figure 23:
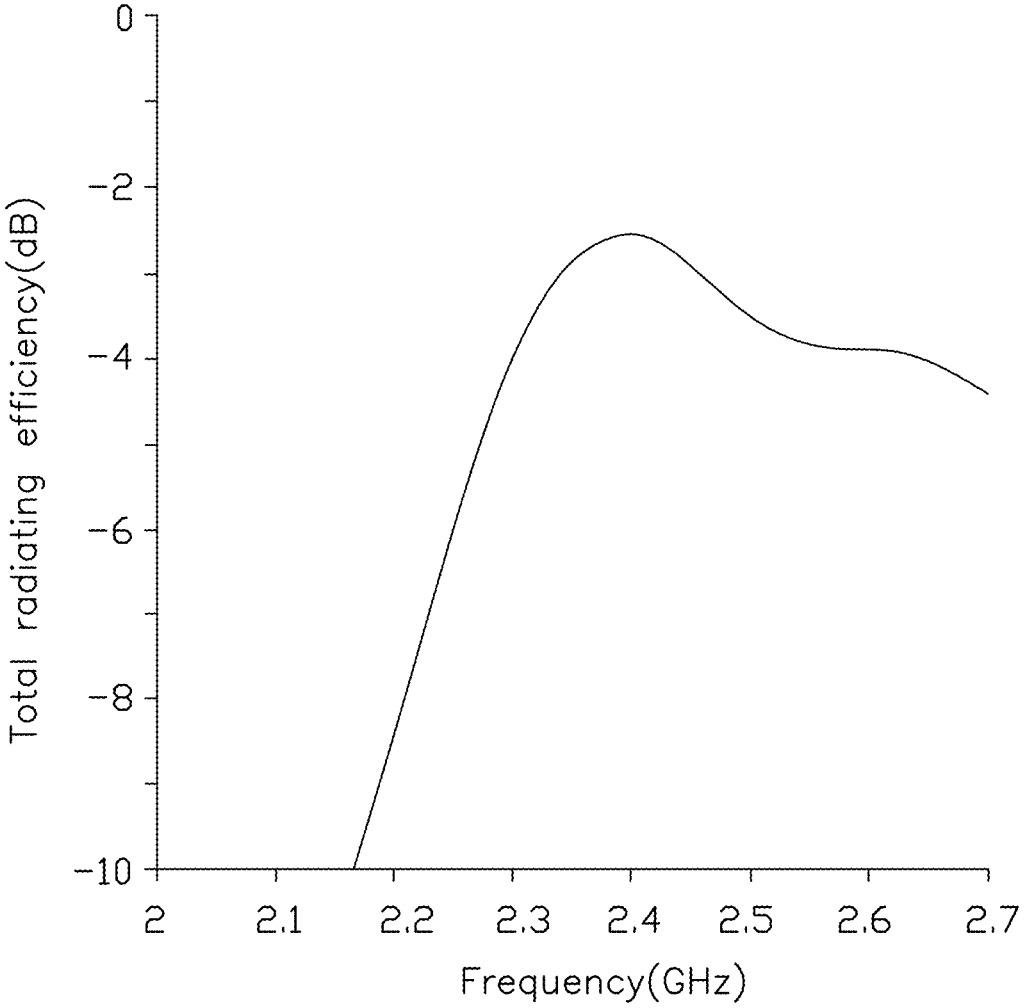
FIG. 23 is a graph of total radiation efficiency of the LTE-A high-frequency mode.

FIG. 23 shows a graph of total radiation efficiency of the LTE-A high-frequency mode.

As shown in FIGS. 18 and 19, the low-frequency mode is excited by the first radiating portion A1, and the switching circuit 15 adjusts the low-frequency band to include the LTE-A Band17, the LTE-A Band13, the LTE-A Band20, and the LTE-A Band8. As shown in FIGS. 20-23, the third feed source 17*b*, the third radiating portion A3, and the coupling portion 20*b* excite the mid-frequency band and includes LTE-A 1710-2170 MHz. The second feed source 16*b* and the second radiating portion A2 excite the high-frequency band and includes LTE-A 2300-2690 MHz.

The switching circuit 15 adjusts the low-frequency band to operate within LTE-A Band17, LTE-A Band13, LTE-A Band20, or LTE-A Band8. Thus, the switching circuit 15 does not affect operation of the mid-high-frequency band LTE-A 1710-2690 MHz.

Figure 24:
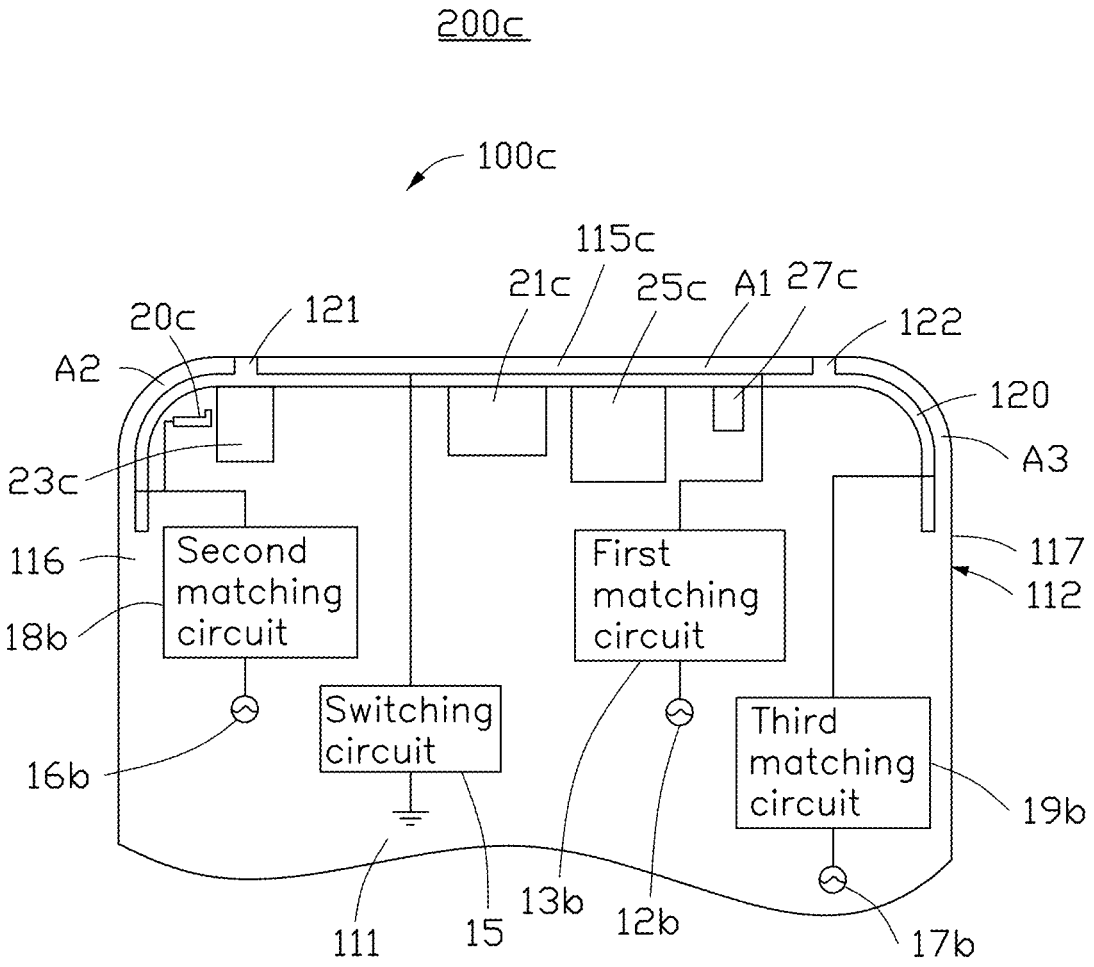
FIG. 24 is a diagram of a fourth embodiment of an antenna structure.

FIG. 24 shows a fourth embodiment of an antenna structure 100*c*.

The antenna structure 100*c* includes a middle frame 111, a border frame 112, a first feed source 12*b*, a first matching circuit 13*b*, a switching circuit 15, a second feed source 16*b*, a third feed source 17*b*, a second matching circuit 18*b*, and a third matching circuit 19*b*. The wireless communication device 200*c* includes a first electronic component 21*c*, a second electronic component 23*c*, and a third electronic component 25*c*.

The border frame 112 includes an end portion 115*c*, a first side portion 116, and a second side portion 117. The housing 11 further includes an slot 120, a first gap 121, and a second gap 122. The slot 120, the first gap 121, and the second gap 122 divide the housing 11 into a first radiating portion A1, a second radiating portion A2, and a third radiating portion A3.

One end of the first feed source 12*b* is electrically coupled to an end of the first radiating portion A1 through the first matching circuit 13*b* adjacent to the second gap 122. Thus, the first feed source 12*b* does not divide the first radiating portion A1 into two sections, and electric current from the first feed source 12*b* flows directly through the first radiating portion A1. One end of the switching circuit 15 is electrically coupled to an end of the first radiating portion A1 adjacent to the first gap 121. A second end of the switching circuit 15 is grounded.

One end of the second feed source 16*b* is electrically coupled to an end of the second radiating portion A2 through the second matching circuit 18*b* away from the first gap 121 for feeding electric current to the second radiating portion A2. One end of the third feed source 17*b* is electrically coupled to an end of the third radiating portion A3 through the third matching circuit 19*b* away from the second gap 122 for feeding electric current to the third radiating portion A3.

One difference between the antenna structure 100*c* and the antenna structure 100*b* is that the end portion 115*c* of the antenna structure 100*c* may be a top end opposite to the bottom end of the wireless communication device 200*c*.

Another difference between the antenna structure 100*c* and the antenna structure 100*b* is that types and locations of the first electronic component 21*c*, the second electronic component 23*c*, and the third electronic component 25*c* are different, and the antenna structure 100*c* further includes a fourth electronic component 27*c*. The first electronic component 21*c* is a microphone mounted within the accommodating space 114. The first electronic component 21*c* is mounted between the first feed source 12*b* and the switching circuit 15 and is insulated from the first radiating portion A1 by the slot 120. The second electronic component 23*c* is an earphone module mounted within the accommodating space 114 and mounted corresponding to the first gap 121. The third electronic component 25*c* is a front camera lens module mounted between the first feed source 12*b* and the first electronic component 21*c* and is insulated from the first radiating portion A1 by the slot 120. The fourth electronic component 27*c* is a microphone mounted between the first feed source 12*b* and the third electronic component 25*c* and is insulated from the first radiating portion A1 by the slot 120

Another difference between the antenna structure 100*c* and the antenna structure 100*b* is that in the antenna structure 100*c*, the coupling portion 20*b* is omitted. The antenna structure 100*c* further includes an extending portion 20*c*. The extending portion 20*c* is made of metal. The extending portion 20*c* is connected and electrically coupled to the second feed source 16*b* and the second radiating portion A2. The extending portion 20*c* extends along a direction parallel to the end portion 115*c* and away from the first side portion 116, and then bends perpendicularly, and then extends along a direction parallel to the first side portion 116 and toward the end portion 115*c*.

Figure 25:
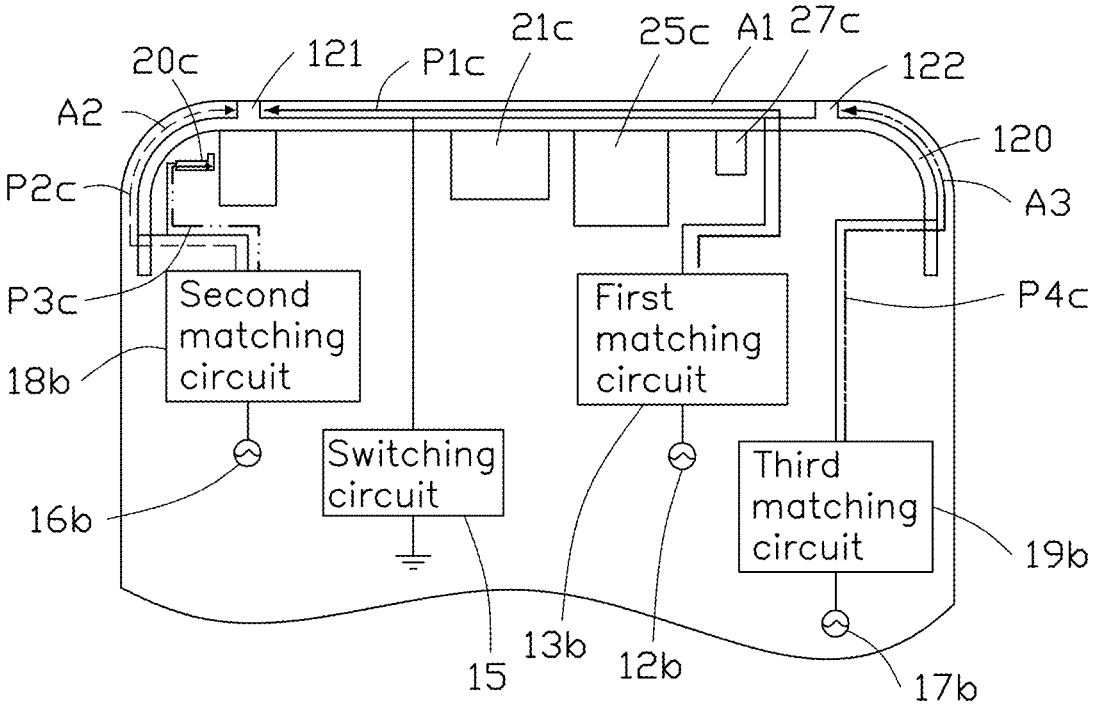
FIG. 25 is a diagram of current paths of the antenna structure in FIG. 24.

As shown in FIG. 25, when the first feed source 12*b* supplies electric current, the electric current from the first feed source 12*b* flows through the first matching circuit 13*b* and the first radiating portion A1 toward the first gap 121 along a circuit path P1*c*. Thus, the first feed source 12*b* and the first radiating portion A1 form a monopole antenna to excite a first resonant mode and generate a radiation signal in a first frequency band.

When the second feed source 16*b* supplies electric current, the electric current from the second feed source 16*b* is split into two currents. A first current flows through the second matching circuit 18*b* and the second radiating portion A2 toward the first gap 121 along a current path P2*c*. Thus, the second feed source 16*b* and the second radiating portion A2 form a monopole antenna to excite a second resonant mode and generate a radiation signal in a second frequency band. A second current flows through the second matching circuit 18*b* and the extending portion 20*c* along a current path P3*c*. Thus, the second feed source 16*b* and the extending portion 20*c* form a monopole antenna to excite a third resonant mode and generate a radiation signal in a third frequency band.

When the third feed source 17*b* supplies electric current, the electric current from the third feed source 17*b* flows through the third matching circuit 19*b* and the third radiating portion A3 toward the second gap 122 along a current path P4*c*. Thus, the third feed source 17*b* and the third radiating portion A3 form a monopole antenna to excite a fourth resonant mode and generate a radiation signal in a fourth frequency band.

In one embodiment, the first resonant mode is a Long Term Evolution Advanced (LTE-A) low-mid-high-frequency mode, the second resonant mode is a WIFI 2.4 GHz frequency mode, the third resonant mode is a WIFI 5 GHz frequency mode, and the fourth resonant mode is a Global Positioning System (GPS) frequency mode. The first frequency band is 700-960 MHz, 1710-2170 MHz, and 2300-2690 MHz. The second frequency band is 2400-2480 MHz. The third frequency band is 5150-5850 MHz. The fourth frequency band is 1575 MHz.

The first feed source 12*b* and the first radiating portion A1 form a diversity antenna. The second feed source 16*b* and the second radiating portion A2 form a WIFI 2.4 GHz antenna. The second feed source 16*b* and the extending portion 20*c* form a WIFI 5 GHz antenna. The third feed source 17*b* and the third radiating portion A3 form a GPS antenna.

Figure 26:
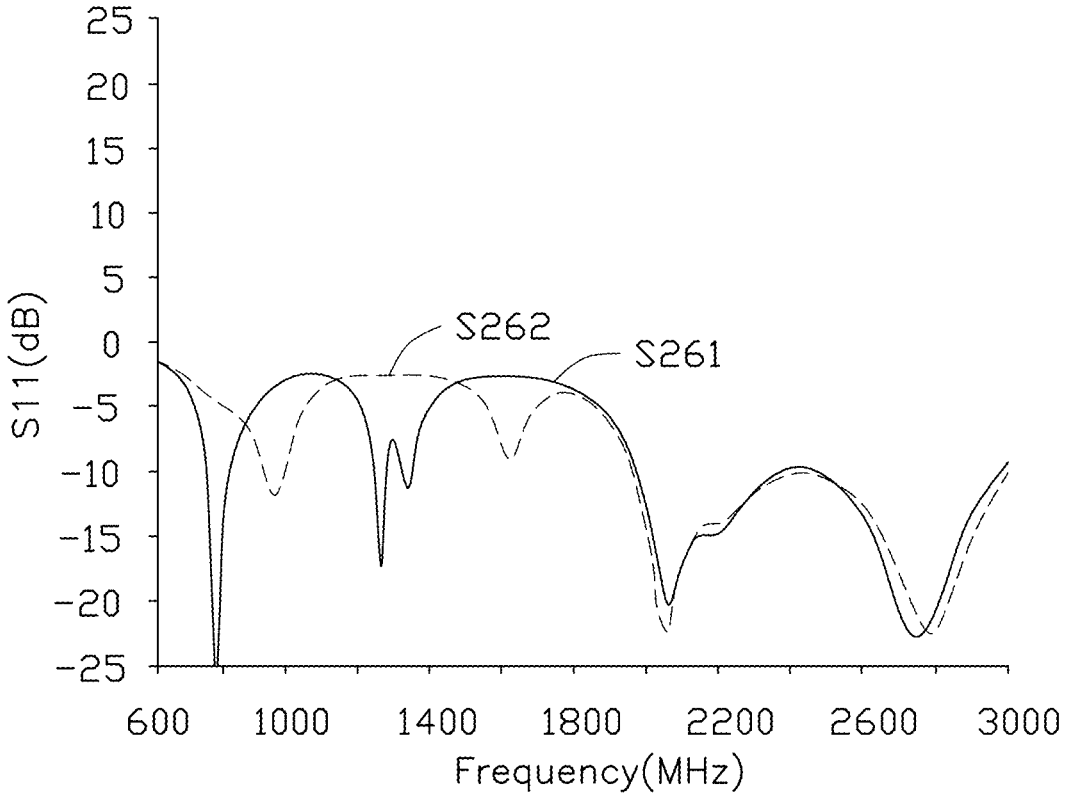
FIG. 26 is a graph of S11 values of the fourth embodiment of the antenna structure.

FIG. 26 shows a graph of scattering values (S11 values) of the antenna structure 100*c*. A plotline S261 represents S11 values of LTE-A Band28 (703-803 MHz) and the LTE-A mid-high-frequency mode. A plotline S262 represents S11 values of LTE-A Band8 (880-960 MHz) and the LTE-A mid-high frequency mode.

Figure 27:
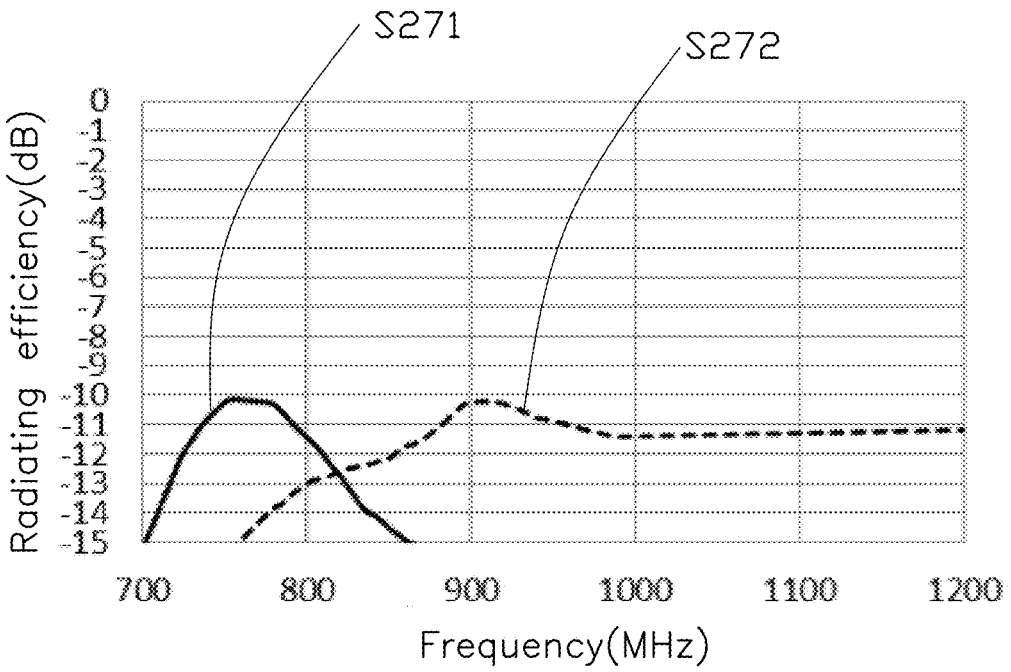
FIG. 27 is a graph of total radiation efficiency of the LTE-A low-frequency mode.

FIG. 27 shows a graph of total radiation efficiency of the LTE-A low-frequency mode. A plotline S271 represents LTE-A Band28 (704-746 MHz). A plotline S272 represents LTE-A Band8 (880-960 MHz).

Figure 28:
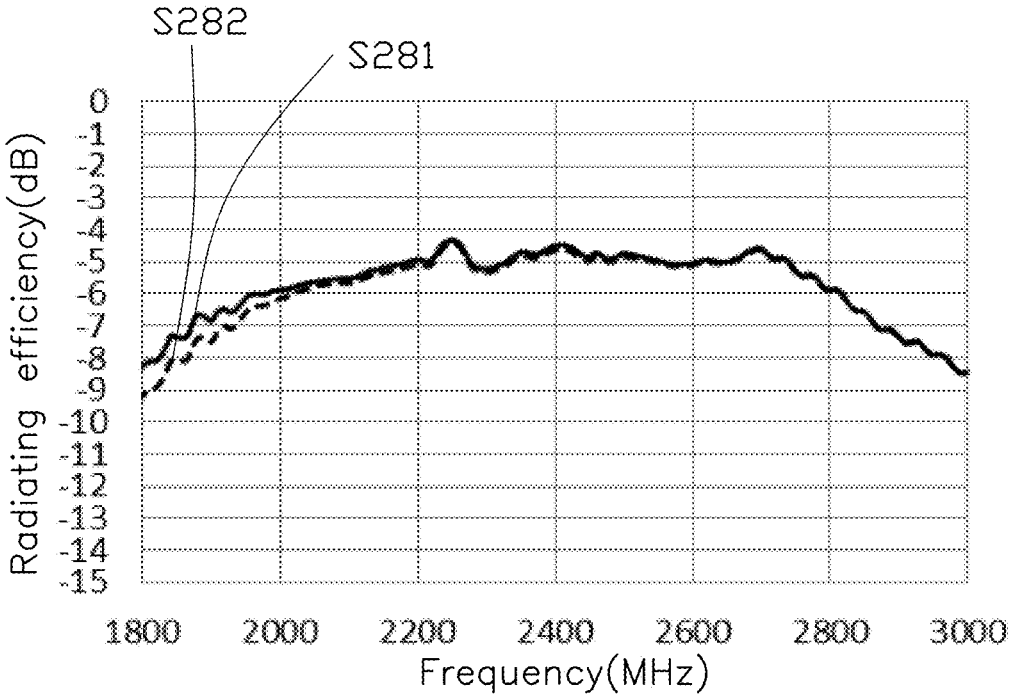
FIG. 28 is a graph of total radiation efficiency of the LTE-A mid-high-frequency mode.

FIG. 28 shows a graph of total radiation efficiency of the LTE-A mid-high-frequency mode. A plotline S281 represents Band 28 when the antenna structure 100*c* operates in the LTE-A mid-high-frequency mode. A plotline S282 represents Band8 when the antenna structure 100*c* operates in the LTE-A mid-high-frequency mode.

Figure 29:
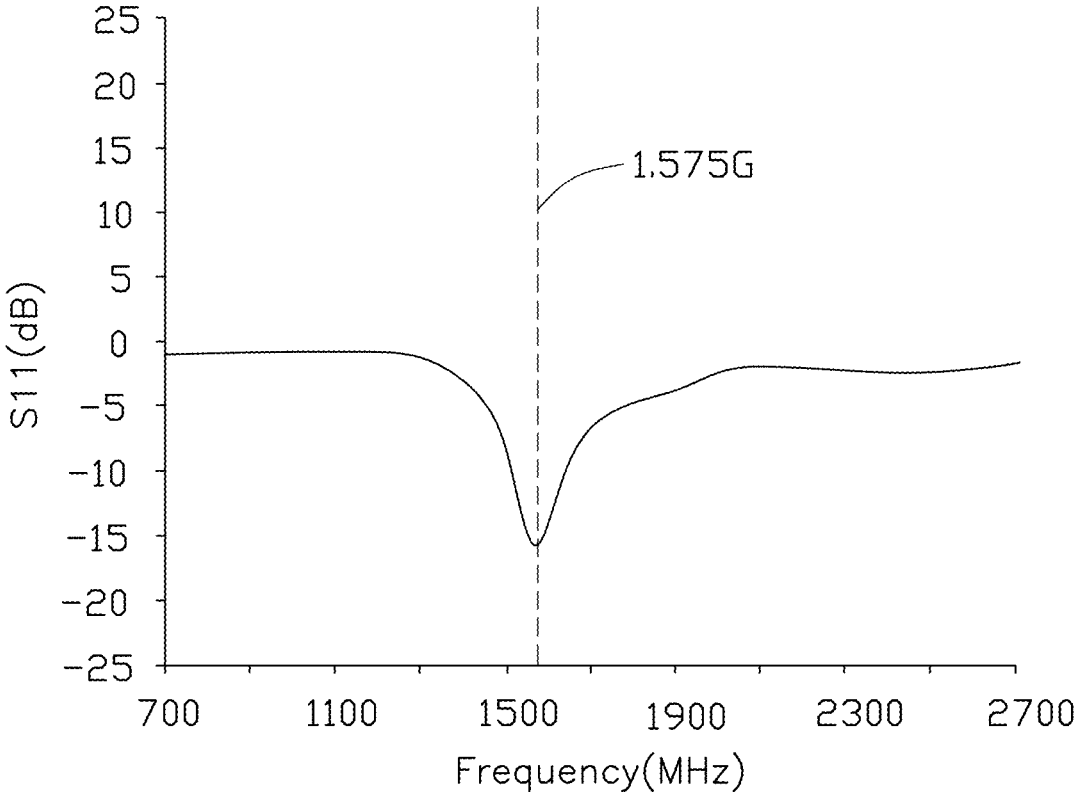
FIG. 29 is a graph of S11 values of a GPS antenna.

FIG. 29 shows a graph of S11 values of the GPS antenna.

Figure 30:
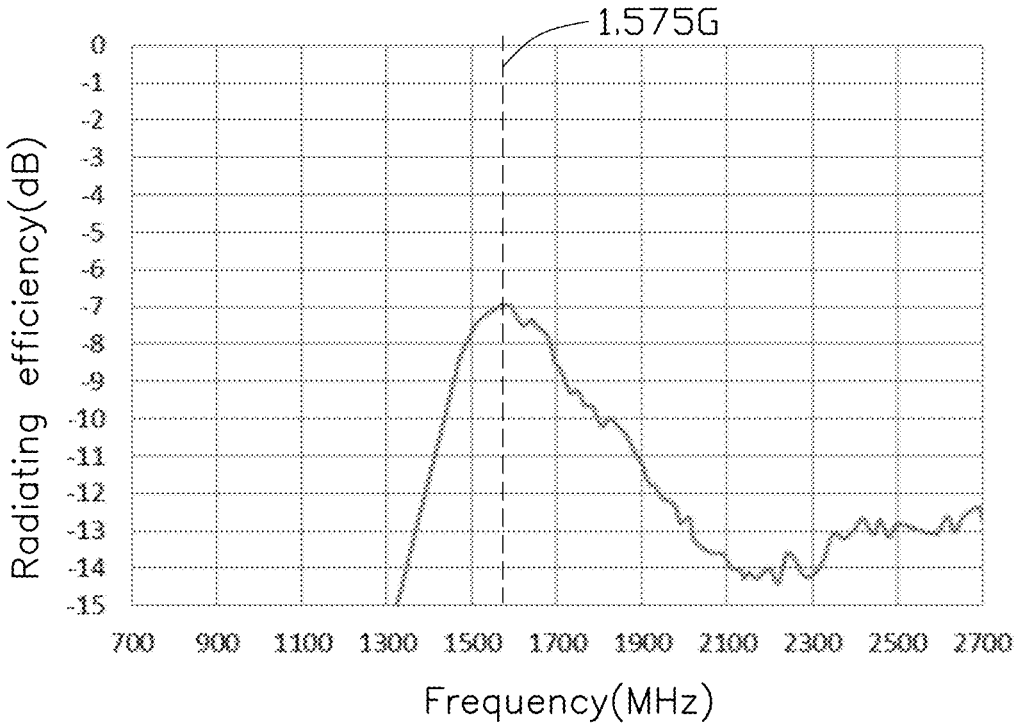
FIG. 30 is a graph of total radiation efficiency of the GPS antenna.

FIG. 30 shows a graph of total radiation efficiency of the GPS antenna.

Figure 31:
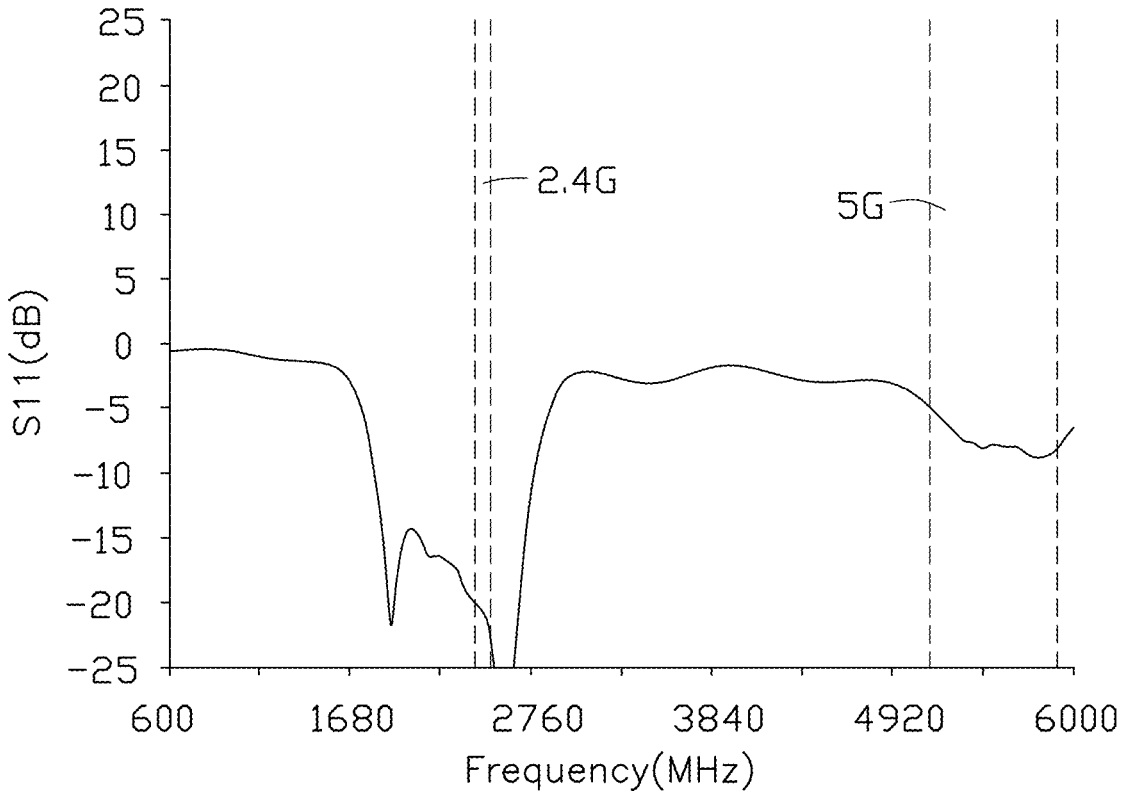
FIG. 31 is a graph of S11 values of a WIFI 2.4 GHz and WIFI 5 GHz antenna.

FIG. 31 shows a graph of S11 values of the WIFI 2.4 GHz and WIFI 5 GHz antenna.

Figure 32:
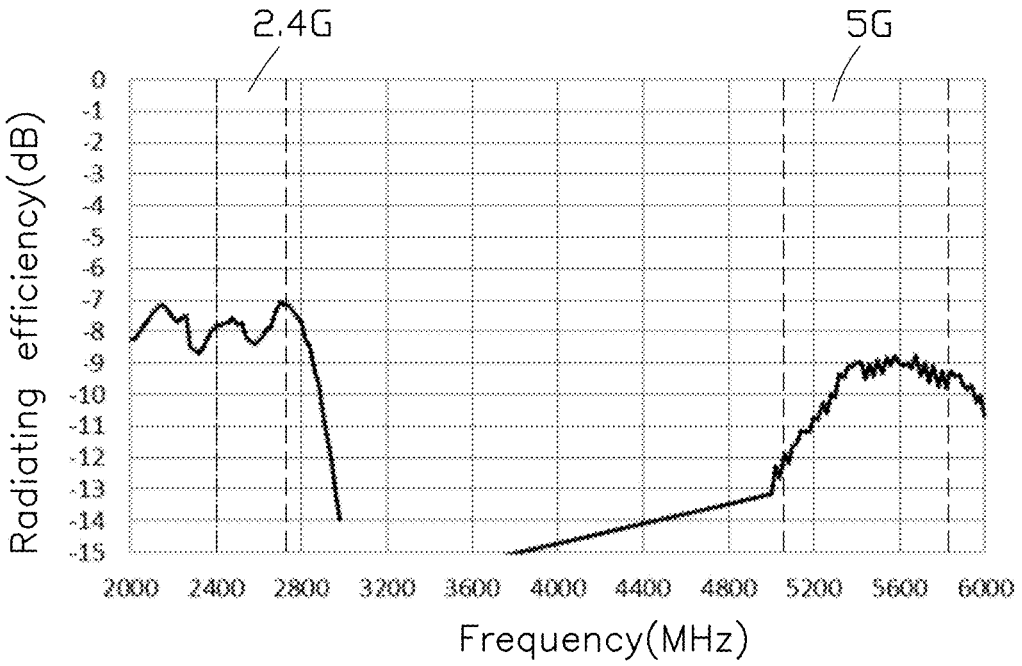
FIG. 32 is a graph of total radiation efficiency of the WIFI 2.4 GHz and WIFI 5 GHz antenna.

FIG. 32 shows a graph of total radiation efficiency of the WIFI 2.4 GHz and WIFI 5 GHz antenna.

As shown in FIGS. 26-32, the low-mid-high-frequency modes are excited by the first feed source 12*b* and the first radiating portion A1, and the switching circuit 15 adjusts the low-frequency band to include the LTE-A Band28 and the LTE-A Band8. The second feed source 16*b*, the second radiating portion A2, and the extending portion 20*c* excite the WIFI 2.4 GHz mode and the WIFI 5 GHz mode. The third feed source 17*b* and the third radiating portion A3 excite the GPS mode.

The switching circuit 15 adjusts the low-frequency band to operate within LTE-A Band28 and LTE-A Band8. Thus, the switching circuit 15 does not affect operation of the mid-high-frequency band, the WIFI 2.4 GHz, the WIFI 5 GHz, and the GPS bands.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An antenna structure comprising:

a housing comprising a middle frame and a border frame, wherein the middle frame and the border frame are made of metal, the border frame is mounted around a periphery of the middle frame, the border frame comprises a slot, a first gap, and a second gap, the slot is in an inner side of the border frame, the first gap and the second gap are in the border frame, the first gap and the second gap cut across and cut through the border frame, the slot, the first gap, and the second gap separate a first radiating portion from the border frame, the first radiating portion is insulated from the middle frame by the slot; and a first feed source electrically coupled to the first radiating portion and configured to provide an electric current to the first radiating portion;

a first group of extending portions and a second group of extending portions;

wherein:

a thickness of the border frame is greater than or equal to twice a width of the first gap or twice a width of the second gap; and a width of the slot is less than or equal to half the width of the first gap or half the width of the second gap;

wherein the border frame comprises an end portion, a first side portion, and a second side portion; the first side portion and the second side portion are respectively connected to opposite ends of the end portion; a portion of the border frame located between the first gap and an endpoint of the slot adjacent to the first side portion is defined as a second radiating portion; a portion of the border frame located between the second gap and an endpoint of the slot adjacent to the second side portion is defined as a third radiating portion;

wherein each of the first and the second groups of extending portions is made of metal;

the first group of extending portions comprises a first extending portion and a second extending portion, the first extending portion of the first group of extending portions is connected to an end of the first radiating section adjacent to the first gap, and the second extending portion of the first group of extending portion is connected to an end of the second radiating portion adjacent to the first gap, and the first and the second extending portions of the first group of extending portions face each other across the first gap;

the second group of extending portions comprises a first extending portion and a second extending portion, the first extending portion of the second group of extending portions is connected to an end of the second radiating section adjacent to the second gap, and the second extending portion of the second group of extending portions is connected to an end of the third radiating portion adjacent to the second gap, and the first and the second extending portions of the second group of extending portions face each other across the second gap.

2. The antenna structure of claim 1, wherein:

the first gap is defined in the end portion adjacent to the first side portion, and the second gap is defined in the end portion adjacent to the second side portion;

the slot is defined in an inner side of the end portion and extends toward the first side portion and the second side portion;

the first radiating portion is a portion of the border frame located between the first gap and the second gap.

3. The antenna structure of claim 2, wherein:

a portion of the border frame located between the first feed source and the first gap is defined as a first radiating section;

a portion of the border frame located between the first feed source and the second gap is defined as a second radiating section;

when the first feed source supplies an electric current, the electric current from the first feed source flows through the first radiating section to excite a first resonant mode and generate a radiation signal in a first frequency band, the electric current from the first feed source flows through the first radiating section and the electric current is electrically coupled to the second radiating portion through the first gap to excite a second resonant mode and generate a radiation signal in a second frequency band, the electric current from the first feed source flows through the second radiating section and the electric current is electrically coupled to the third radiating portion through the second gap to excite a third resonant mode and generate a radiation signal in a third frequency band.

4. The antenna structure of claim 3, wherein:

the first resonant mode is a Long Term Evolution Advanced (LTE-A) low-frequency mode;

the second resonant mode is an LTE-A high-frequency mode;

the third resonant mode is an LTE-A mid-frequency mode.

5. The antenna structure of claim 2, wherein:

a portion of the border frame between the first feed source and the first gap is defined as a first radiating section;

a portion of the border frame between the first feed source and the second gap is defined as a second radiating section;

when the first feed source supplies an electric current, the electric current from the first feed source flows through the first radiating section to excite a first resonant mode and generate a radiation signal in a first frequency band, the electric current from the first feed source flows through the first radiating section and the electric current is electrically coupled to the second radiating portion through the first gap to excite a second resonant mode and generate a radiation signal in a second frequency band, the electric current from the first feed source flows through the second radiating section toward the second gap to excite a third resonant mode and generate a radiation signal in a third frequency band.

6. The antenna structure of claim 5, wherein:

the first resonant mode is an LTE-A low-frequency mode;

the second resonant mode is an LTE-A mid-high-frequency mode; and the third resonant mode is an LTE-A mid-frequency mode.

7. The antenna structure of claim 5 further comprising a ground portion made of metal; wherein:

the ground portion is curved;

a first end of the ground portion is electrically coupled to the first feed source and the first radiating portion, and a second end of the ground portion is grounded.

8. The antenna structure of claim 1, wherein the middle frame and the border frame are integrally formed.

9. A wireless communication device comprising an antenna structure, the antenna structure comprising:

a housing comprising a middle frame and a border frame, wherein the middle frame and the border frame are made of metal, the border frame is mounted around a periphery of the middle frame, the border frame comprises a slot, a first gap, and a second gap, the slot is in an inner side of the border frame, the first gap and the second gap are in the border frame, the first gap and the second gap cut across and cut through the border frame, the slot, the first gap, and the second gap separate a first radiating portion from the border frame, the first radiating portion is insulated from the middle frame by the slot; and a first feed source electrically coupled to the first radiating portion and configured to provide an electric current to the first radiating portion;

a first group of extending portions and a second group of extending portions;

wherein:

a thickness of the border frame is greater than or equal to twice a width of the first gap or twice a width of the second gap; and a width of the slot is less than or equal to half the width of the first gap or half the width of the second gap;

wherein the border frame comprises an end portion, a first side portion, and a second side portion; the first side portion and the second side portion are respectively connected to opposite ends of the end portion; a portion of the border frame located between the first gap and an endpoint of the slot adjacent to the first side portion is defined as a second radiating portion; a portion of the border frame located between the second gap and an endpoint of the slot adjacent to the second side portion is defined as a third radiating portion;

wherein each of the first and the second groups of extending portions is made of metal;

the first group of extending portions comprises a first extending portion and a second extending portion, the first extending portion of the first group of extending portions is connected to an end of the first radiating section adjacent to the first gap, and the second extending portion of the first group of extending portion is connected to an end of the second radiating portion adjacent to the first gap, and the first and the second extending portions of the first group of extending portions face each other across the first gap;

the second group of extending portions comprises a first extending portion and a second extending portion, the first extending portion of the second group of extending portions is connected to an end of the second radiating section adjacent to the second gap, and the second extending portion of the second group of extending portions is connected to an end of the third radiating portion adjacent to the second gap, and the first and the second extending portions of the second group of extending portions face each other across the second gap.

10. The wireless communication device of claim 9, wherein:

the first gap is defined in the end portion adjacent to the first side portion, and the second gap is defined in the end portion adjacent to the second side portion;

the slot is defined in an inner side of the end portion and extends toward the first side portion and the second side portion;

the first radiating portion is a portion of the border frame located between the first gap and the second gap.

11. The wireless communication device of claim 10, wherein:

a portion of the border frame located between the first feed source and the first gap is defined as a first radiating section;

a portion of the border frame located between the first feed source and the second gap is defined as a second radiating section;

when the first feed source supplies an electric current, the electric current from the first feed source flows through the first radiating section to excite a first resonant mode and generate a radiation signal in a first frequency band, the electric current from the first feed source flows through the first radiating section and the electric current is electrically coupled to the second radiating portion through the first gap to excite a second resonant mode and generate a radiation signal in a second frequency band, the electric current from the first feed source flows through the second radiating section and the electric current is electrically coupled to the third radiating portion through the second gap to excite a third resonant mode and generate a radiation signal in a third frequency band.

12. The wireless communication device of claim 10 further comprising a second feed source and a third feed source, wherein:

a portion of the border frame between the second gap and an end of the slot adjacent to the second side portion is defined as a third radiating portion;

the second feed source is electrically coupled to the second radiating portion; and the third feed source is electrically coupled to the third radiating portion.

13. An antenna structure comprising:

a housing comprising a middle frame and a border frame, wherein the middle frame and the border frame are made of metal, the border frame is mounted around a periphery of the middle frame, the border frame comprises a slot, a first gap, and a second gap, the slot is in an inner side of the border frame, the first gap and the second gap are in the border frame, the first gap and the second gap cut across and cut through the border frame, the slot, the first gap, and the second gap separate a first radiating portion from the border frame, the first radiating portion is insulated from the middle frame by the slot; and a first feed source electrically coupled to the first radiating portion and configured to provide an electric current to the first radiating portion;

a coupling portion being substantially L-shaped and made of metal;

wherein:

a thickness of the border frame is greater than or equal to twice a width of the first gap or twice a width of the second gap; and a width of the slot is less than or equal to half the width of the first gap or half the width of the second gap;

the border frame comprises an end portion, a first side portion, and a second side portion; the first side portion and the second side portion are respectively connected to opposite ends of the end portion; a portion of the border frame between the second gap and an end of the slot adjacent to the second side portion is defined as a third radiating portion;

the coupling portion is electrically coupled to an end of the third radiating portion adjacent to the second gap, the coupling portion extends along a direction away from the end portion and parallel to the first side portion, and then bends perpendicularly, and then extends along a direction parallel to the end portion and toward the first side portion until beyond the second gap.

14. The antenna structure of claim 13, wherein:

the first gap is defined in the end portion adjacent to the first side portion, and the second gap is defined in the end portion adjacent to the second side portion;

the slot is defined in an inner side of the end portion and extends toward the first side portion and the second side portion;

the first radiating portion is a portion of the border frame located between the first gap and the second gap;

a portion of the border frame located between the first gap and an endpoint of the slot adjacent to the first side portion is defined as a second radiating portion.

15. The antenna structure of claim 14, further comprising a second feed source and a third feed source, wherein:

the second feed source is electrically coupled to the second radiating portion; and the third feed source is electrically coupled to the third radiating portion.

16. The antenna structure of claim 15, wherein:

when the first feed source supplies an electric current, the electric current from the first feed source flows through the first radiating portion toward the first gap to excite a first resonant mode and generate a radiation signal in a first frequency band;

when the second feed source supplies an electric current, the electric current from the second feed source flows through the second radiating portion to excite a second resonant mode and generate a radiation signal in a second frequency band; and when the third feed source supplies an electric current, the electric current from the third feed source splits into a first current and a second current, the first current flows through the third radiating portion and the second current flows from the third radiating portion to the coupling portion to cooperatively excite a third resonant mode and generate a radiation signal in a third frequency band.

17. The antenna structure of claim 16, wherein:

the first resonant mode is an LTE-A low-frequency mode;

the second resonant mode is an LTE-A high-frequency mode;

the third resonant mode is an LTE-A mid-frequency mode.

18. The antenna structure of claim 15, further comprising an extending portion which is made of metal, wherein:

the end portion is a top end of a wireless communication device;

the extending portion is electrically coupled to the second feed source and the second radiating portion, the extending portion extends along a direction parallel to the end portion and away from the first side portion, and then bends perpendicularly, and then extends along a direction parallel to the first side portion and toward the end portion.

19. The antenna structure of claim 18, wherein:

when the first feed source supplies an electric current, the electric current from the first feed source flows through the first radiating portion toward the first gap to excite a first resonant mode and generate a radiation signal in a first frequency band;

when the second feed source supplies an electric current, the electric current from the second feed source splits into a first current and a second current, the first current flows through the second radiating portion toward the first gap to excite a second resonant mode and generate a radiation signal in a second frequency band, and the second current flows through the extending portion to excite a third resonant mode and generate a radiation signal in a third frequency band;

when the third feed source supplies an electric current, the electric current from the third feed source flows through the third radiating portion toward the second gap to excite a fourth resonant mode and generate a radiation signal in a fourth frequency band.

20. The antenna structure of claim 19, wherein:

the first resonant mode is an LTE-A low-mid-high-frequency mode;

the second resonant mode is a WIFI 2.4 GHz mode;

the third resonant mode is a WIFI 5 GHz mode; and the fourth resonant mode is a Global Positioning System (GPS) mode.

* * * * *